US010280698B2

(12) United States Patent
Potts et al.

(10) Patent No.: US 10,280,698 B2
(45) Date of Patent: May 7, 2019

(54) WELL RESTIMULATION DOWNHOLE ASSEMBLY

(71) Applicant: GENERAL ELECTRIC COMPANY, Schenectady, NY (US)

(72) Inventors: Jeffrey Robert Potts, Oklahoma City, OK (US); Dewey Lavonne Parkey, Jr., Oklahoma City, OK (US); Matthew Landon George, Oklahoma City, OK (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 256 days.

(21) Appl. No.: 15/332,211

(22) Filed: Oct. 24, 2016

(65) Prior Publication Data

US 2018/0112486 A1 Apr. 26, 2018

(51) Int. Cl.
*E21B 23/01* (2006.01)
*E21B 43/26* (2006.01)
(Continued)

(52) U.S. Cl.
CPC ..... *E21B 23/01* (2013.01); *E21B 4/18* (2013.01); *E21B 23/14* (2013.01);
(Continued)

(58) Field of Classification Search
CPC .... E21B 23/01; E21B 23/03; E21B 2023/008; E21B 43/26; E21B 43/103; E21B 43/105; E21B 43/108; E21B 33/138; E21B 29/10
(Continued)

(56) References Cited

U.S. PATENT DOCUMENTS 6,675,901 B2 1/2004 Johnson et al.
7,478,676 B2 1/2009 East et al.
(Continued)

FOREIGN PATENT DOCUMENTS

WO 2016011327 A2 1/2016
WO 2016/068917 A1 5/2016

OTHER PUBLICATIONS

Wellhoefer et al., "Retrievable Fracturing Sleeve System and Chemical Diversion Packer for Multi-Stage Re-Stimulation of Unconventional Wellbores", On the Practical Side, pp. 1-7, http://www.halliburton.com/public/cpscontents/Papers_and_Articles/web/1-16HFJournal-Retrievable-Frac-Sleeve-System.pdf.
(Continued)

*Primary Examiner* — Kenneth L Thompson
(74) *Attorney, Agent, or Firm* — GE Global Patent Operation

(57) ABSTRACT

A downhole assembly is provided for use in well restimulation, the assembly having a plurality of perforation blocking sleeves each comprising an anchoring device; one or more expandable members secured to an external surface of each of the perforation blocking sleeves; a running tool for transporting the plurality of perforation blocking sleeves and expandable members within a perforated well casing; a running tool driver for moving the running tool, perforation blocking sleeves and expandable members within the well casing; and one or more sensors to detect perforation clusters within the well casing. The anchoring device is used to secure each sleeve over a perforation cluster within the well casing. Each perforation blocking sleeve defines a flow channel in fluid communication with the principal flow channel of the well casing. The running tool is remotely uncoupled from the blocking sleeves in sequence, and the running tool and the running tool driver are retractable
(Continued)

through the flow channel of each the perforation blocking sleeves.

24 Claims, 18 Drawing Sheets

(51) Int. Cl.

| | |
|---|---|
| ***E21B 23/14*** | (2006.01) |
| ***E21B 33/129*** | (2006.01) |
| ***E21B 43/11*** | (2006.01) |
| ***E21B 4/18*** | (2006.01) |
| *E21B 23/00* | (2006.01) |

(52) U.S. Cl.
CPC ..... *E21B 33/1293* (2013.01); *E21B 43/11* (2013.01); *E21B 43/26* (2013.01); *E21B 2023/008* (2013.01)

(58) Field of Classification Search
USPC ..... 166/277, 381, 387
See application file for complete search history.

(56) References Cited

U.S. PATENT DOCUMENTS

| | | | | |
|---|---|---|---|---|
| 7,543,636 | B2 * | 6/2009 | Malone | E21B 34/14 166/252.4 |
| 7,565,929 | B2 | 7/2009 | Bustos et al. | |
| 8,167,043 | B2 | 5/2012 | Willberg et al. | |
| 8,857,513 | B2 | 10/2014 | O'Malley | |
| 8,881,821 | B2 | 11/2014 | O'Malley | |
| 8,887,803 | B2 | 11/2014 | East et al. | |
| 9,145,744 | B2 | 9/2015 | Jordan | |
| 9,206,659 | B2 | 12/2015 | Zhang et al. | |
| 2005/0000692 | A1 | 1/2005 | Cook et al. | |
| 2007/0095532 | A1 * | 5/2007 | Head | E21B 29/10 166/277 |
| 2011/0278017 | A1 | 11/2011 | Themig et al. | |
| 2013/0192828 | A1 | 8/2013 | Kniffin et al. | |
| 2014/0027118 | A1 | 1/2014 | Delange et al. | |
| 2014/0048271 | A1 | 2/2014 | Coon et al. | |
| 2014/0076446 | A1 | 3/2014 | O'Connell et al. | |
| 2014/0208843 | A1 | 7/2014 | Godfrey | |
| 2015/0053397 | A1 | 2/2015 | Filyukov et al. | |
| 2015/0114639 | A1 | 4/2015 | Williamson et al. | |
| 2015/0144347 | A1 | 5/2015 | Brannon et al. | |
| 2015/0204176 | A1 | 7/2015 | Cunningham et al. | |
| 2015/0315890 | A1 | 11/2015 | Tolman et al. | |
| 2015/0354334 | A1 | 12/2015 | Richard et al. | |
| 2015/0361761 | A1 | 12/2015 | Lafferty et al. | |
| 2016/0003019 | A1 | 1/2016 | Safariforoshani et al. | |
| 2016/0003021 | A1 | 1/2016 | Nelson | |
| 2016/0053568 | A1 | 2/2016 | Saltel et al. | |
| 2016/0123117 | A1 | 5/2016 | Gu et al. | |
| 2018/0112489 | A1 * | 4/2018 | Potts | E21B 33/129 |
| 2018/0202269 | A1 * | 7/2018 | Wensrich | E21B 43/116 |

OTHER PUBLICATIONS

"Tubing Casing Patch Technologies", Core Laboratories, http://www.corelab.com/owen/tubcasingpatch-landing, 2016.

Jeong, H.M., "Shape memory polyurethane containing amorphous reversible phase," Journal of Materials Science, vol. 35, Issue 7, pp. 1579-1583 (2000) (Abstract).

Shi, Y., et al., "High Temperature Shape Memory Polymers," Macromolecules, vol. 46, Issue 10, pp. 4160-4167 (2013) (Abstract).

International Search Report and Written Opinion issued in connection with corresponding PCT Application No. PCT/US2017/057996 dated Feb. 7, 2018.

* cited by examiner

WELL RESTIMULATION DOWNHOLE ASSEMBLY

This disclosure relates to equipment and methods useful in the restimulation of hydraulically fractured wells. In particular, this disclosure relates to equipment and methods useful in the restimulation of hydrocarbon-producing wells.

BACKGROUND

Hydraulic fracturing is currently an important technique for accessing previously inaccessible hydrocarbon resources trapped within certain hydrocarbon-containing geologic formations. Hydraulic fracturing stimulates the flow of the hydrocarbon resource through fissures created in the formation and into the wellbore of a well drilled into the formation and results in enhanced recovery of the hydrocarbon resource relative to a similarly situated well created without the use of hydraulic fracturing.

A key technical difficulty is that the production rate of hydrocarbon resources from the formation decreases rapidly with time. This is believed be to be due in part to the susceptibility of the fissures to closure. In effort to restore the production rate and increase ultimate recovery of hydrocarbons from the formation, some operators restimulate wells by repeating the hydraulic fracturing treatment at additional locations within the wellbore. The restimulation treatment may be used to re-open closed fissures by pumping into existing perforations, or to hydraulically fracture new intervals of the formation which were not fractured initially, or both. Effective restimulation necessitates at least temporarily blocking perforations made in the well casing during an initial hydraulic fracturing of the hydrocarbon-containing formation.

Various perforation blocking techniques are currently available, diverting agents, coiled tubing intervention and expandable liners among them. Such currently available techniques suffer from one or more deficiencies, including unreliability and high cost and further advances in well restimulation are needed.

BRIEF DESCRIPTION

In one embodiment, the present invention provides a downhole assembly for use in well restimulation comprising: (a) a plurality of perforation blocking sleeves each comprising a first anchoring device; (b) one or more expandable members secured to an external surface of each of the perforation blocking sleeves; (c) a running tool for transporting the plurality of perforation blocking sleeves and expandable members within a perforated well casing; (d) a running tool driver for moving the running tool, perforation blocking sleeves and expandable members within the perforated well casing; and (e) one or more sensors configured detect perforation clusters within the perforated well casing; wherein the first anchoring device may be used to secure each perforation blocking sleeve over a perforation cluster within the perforated well casing, each perforation blocking sleeve defining a flow channel in fluid communication with a principal flow channel defined by the well casing; wherein the running tool may be remotely and individually uncoupled from each of the perforation blocking sleeves; and wherein the running tool and the running tool driver are retractable through the flow channel of each the perforation blocking sleeves.

In an alternate embodiment, the present invention provides a method of restimulating a well, the method comprising: (a) introducing into a perforated well casing within a previously hydraulically fractured hydrocarbon-producing formation a running tool driver, a running tool to which are reversibly coupled a plurality of perforation blocking sleeves, and one or more expandable members secured to an external surface of each of the perforation blocking sleeves, each perforation blocking member defining a flow channel in fluid communication with a principal flow channel defined by the well casing; (b) locating a first perforation cluster using one or more sensors operationally linked to the running tool; (c) positioning a first perforation blocking member over the first perforation cluster; (d) deploying a first anchoring device to secure the first perforation blocking sleeve over the first perforation cluster; (e) remotely uncoupling the first perforation blocking sleeve from the running tool; (f) retracting the running tool and running tool driver through the flow channel of the first perforation blocking sleeve; (g) repeating steps (b)-(f) until each of the plurality of perforation blocking sleeves is secured over a respective perforation cluster and the running tool and running tool driver have been retracted through the flow channel of a last perforation blocking sleeve; (h) expanding the one or more expandable members to effectively inhibit fluid flow through the perforation clusters; (i) creating one or more new perforation clusters in the well casing; and (j) hydraulically fracturing the hydrocarbon-producing formation via the one or more new perforation clusters.

In yet another embodiment, the present invention provides a downhole assembly for use in well restimulation comprising: (a) a plurality of perforation blocking sleeves each comprising a first anchoring device; (b) at least one expandable collar comprising a shape-memory organic polymer which expands when its glass transition temperature is exceeded, the expandable collar being secured to an external surface of each of the perforation blocking sleeves; (c) a running tool for transporting the plurality of perforation blocking sleeves and expandable collars within a perforated well casing; (d) a running tool driver for moving the running tool, perforation blocking sleeves and expandable collars within the perforated well casing; and (e) one or more sensors configured detect perforation clusters within the perforated well casing; wherein the first anchoring device may be used to secure each perforation blocking sleeve over a perforation cluster within a perforated well casing, each perforation blocking sleeve defining a flow channel in fluid communication with a principal flow channel defined by the well casing; wherein the running tool may be remotely and individually uncoupled from each of the perforation blocking sleeves; and wherein the running tool and the running tool driver are retractable through the flow channel of each the perforation blocking sleeves.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

Figure 7:
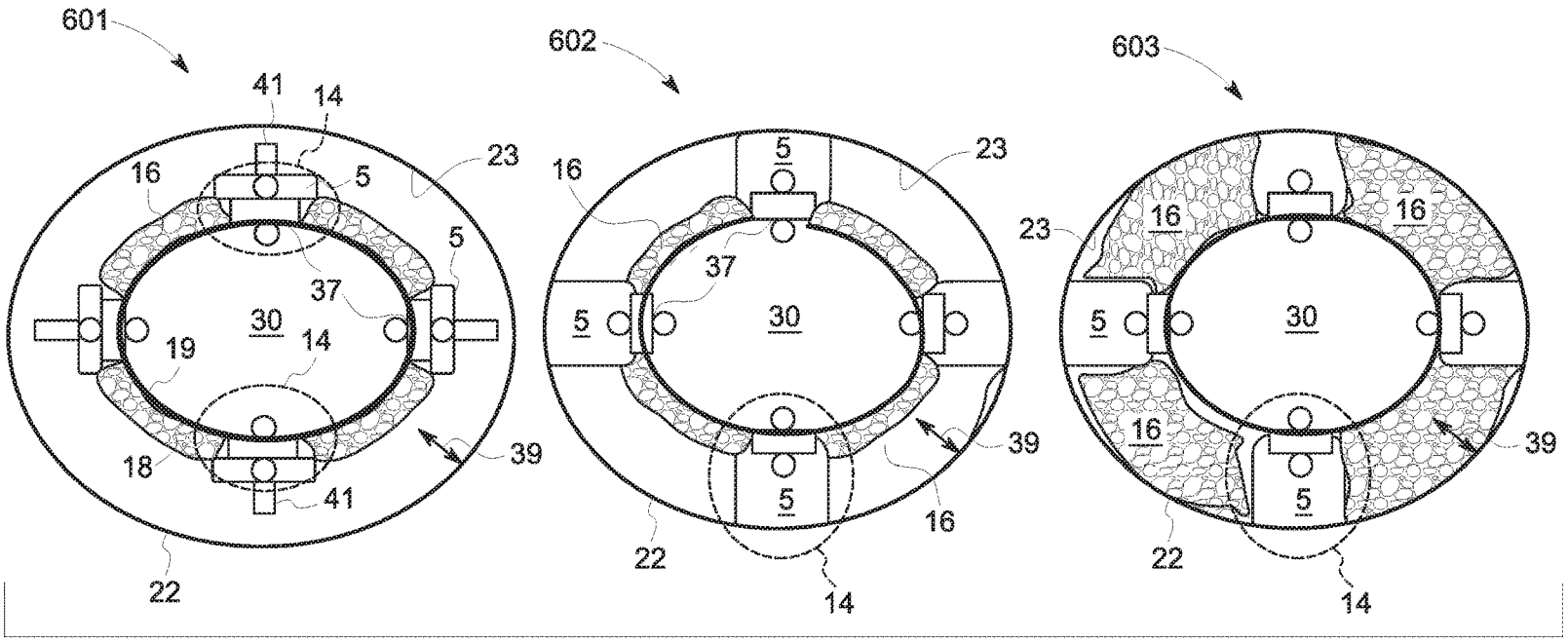

FIG. 7 further illustrates the deployment of a perforation blocking sleeve from a downhole assembly according to one or more embodiments of the present invention.

Figure 8A:
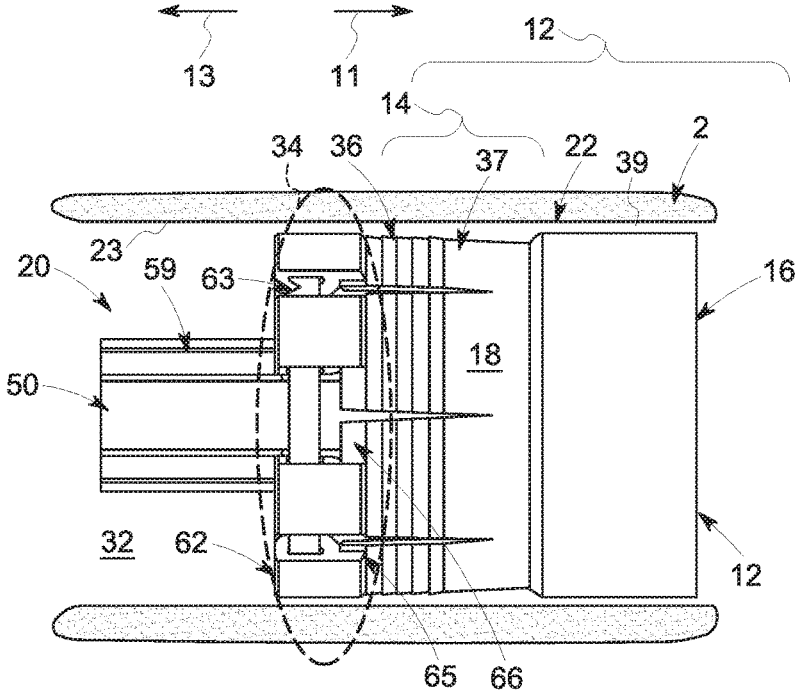
Figure 8B:
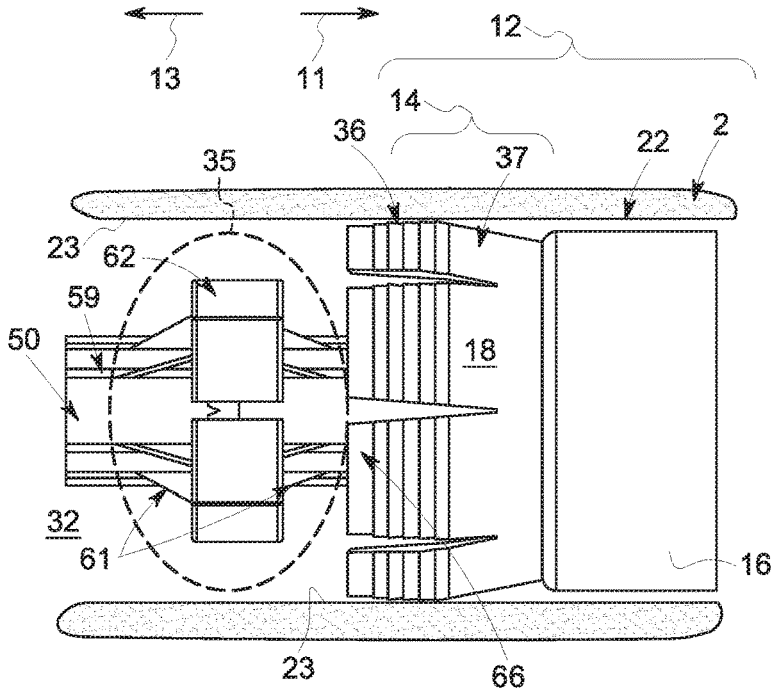

FIG. 8(*a*) illustrates components of a downhole assembly according to one or more embodiments of the present invention.

FIG. 8(*b*) illustrates components of a downhole assembly according to one or more embodiments of the present invention.

Figure 9A:
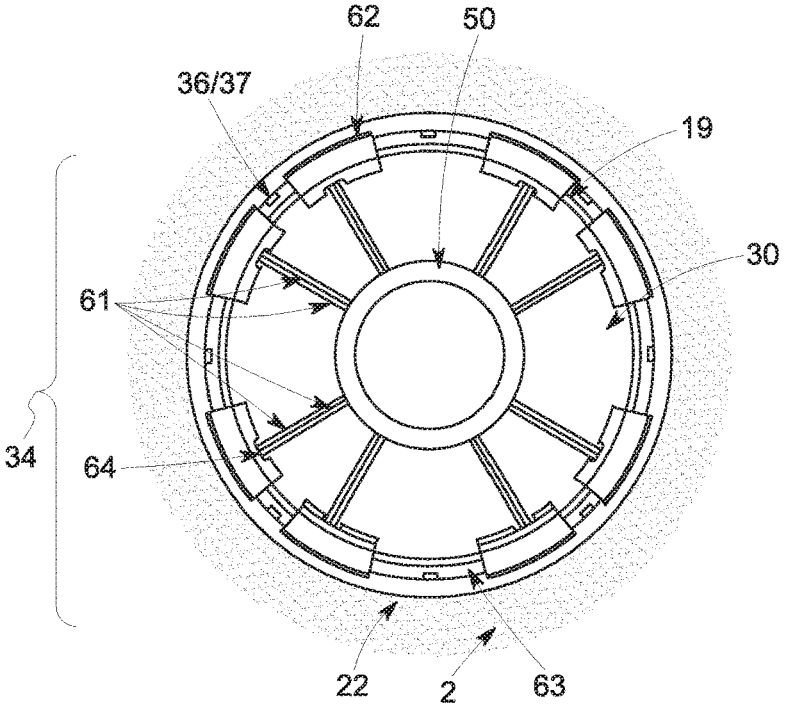
Figure 9B:
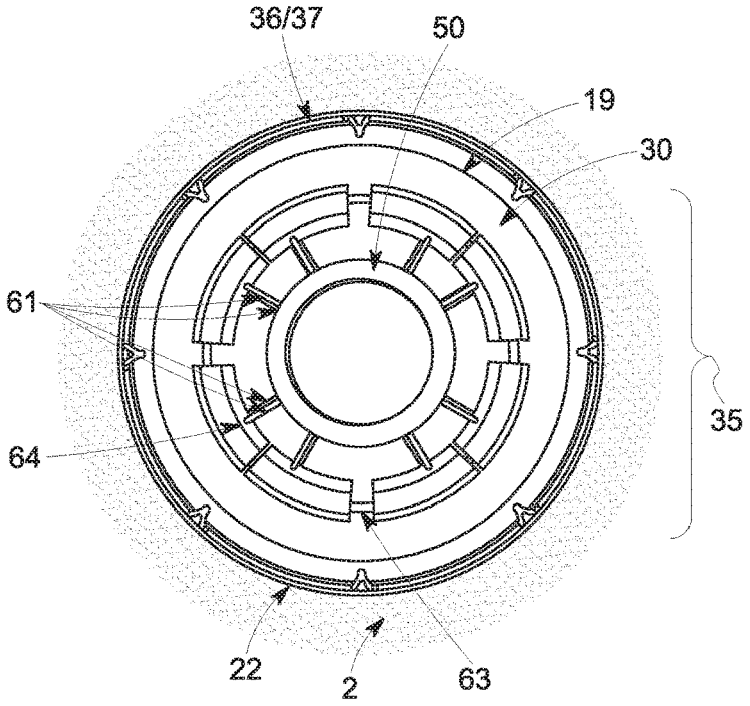

FIG. 9(*a*) illustrates components of a downhole assembly according to one or more embodiments of the present invention.

FIG. 9(*b*) illustrates components of a downhole assembly according to one or more embodiments of the present invention.

Figure 10:
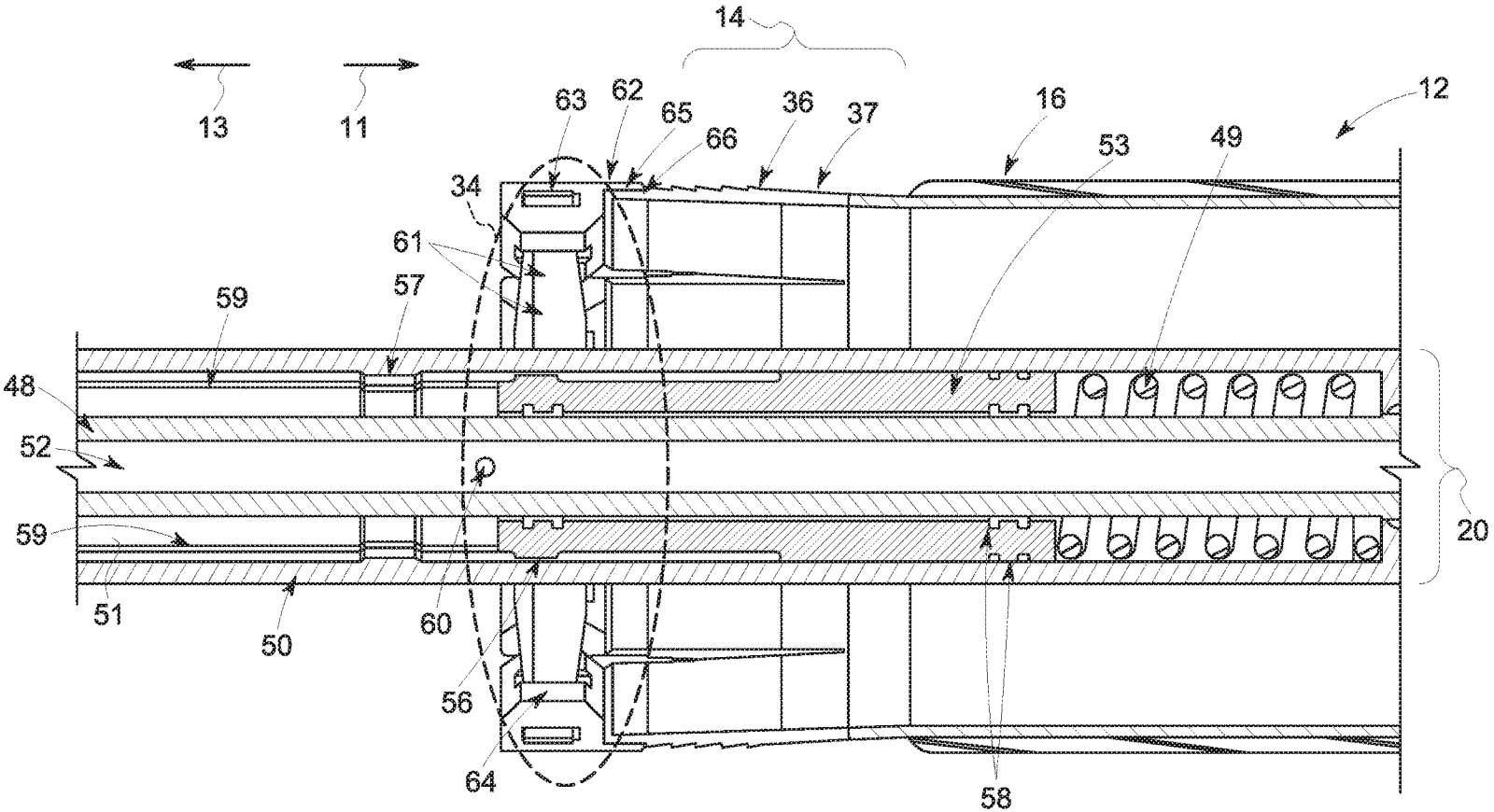
Figure 11:
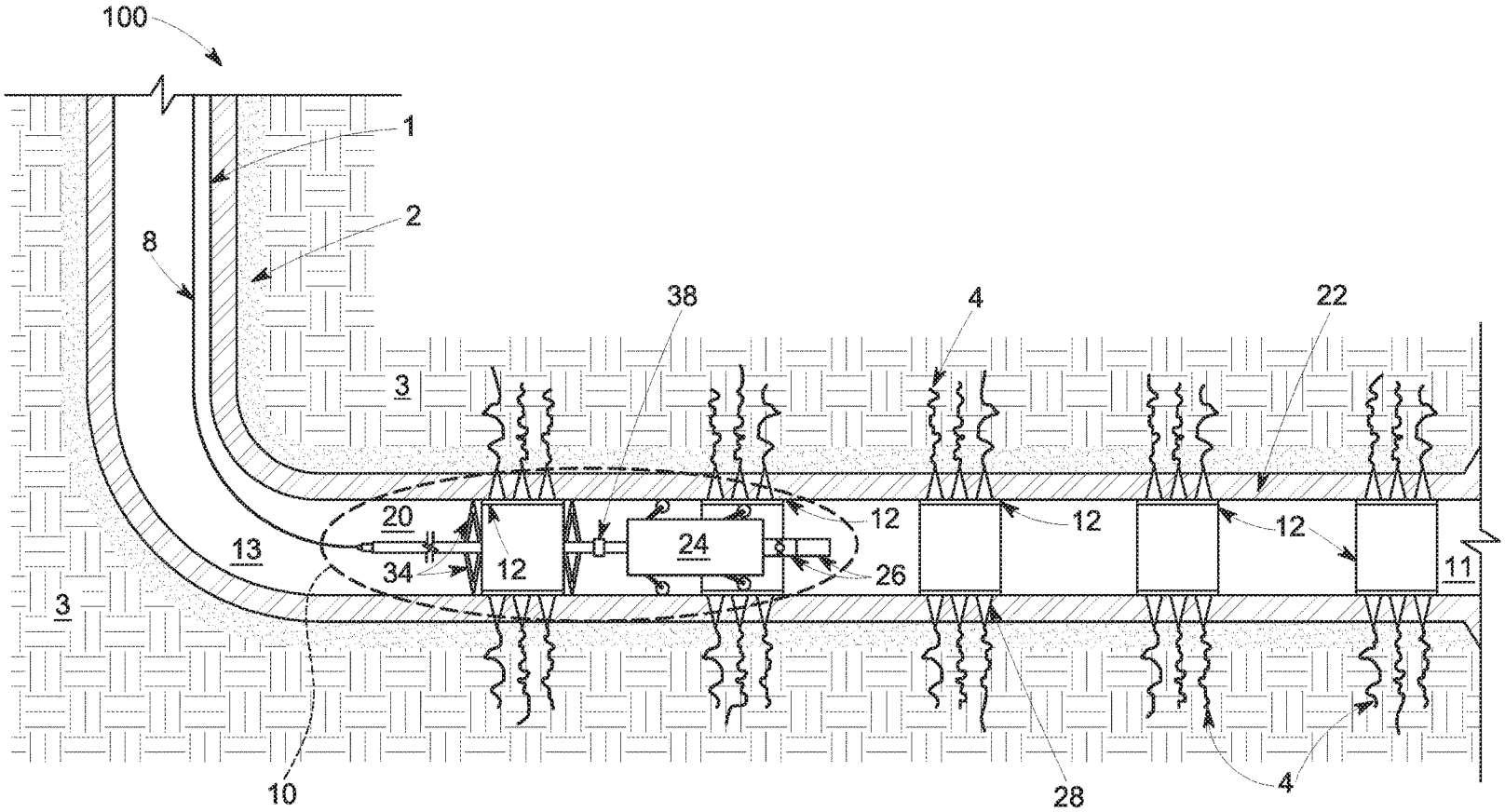

FIG. 10 illustrates components of a downhole assembly according to one or more embodiments of the present invention FIG. 11 illustrates a downhole assembly deployment and retrieval protocol used in a perforated well casing according to one or more embodiments of the present invention.

Figure 12:
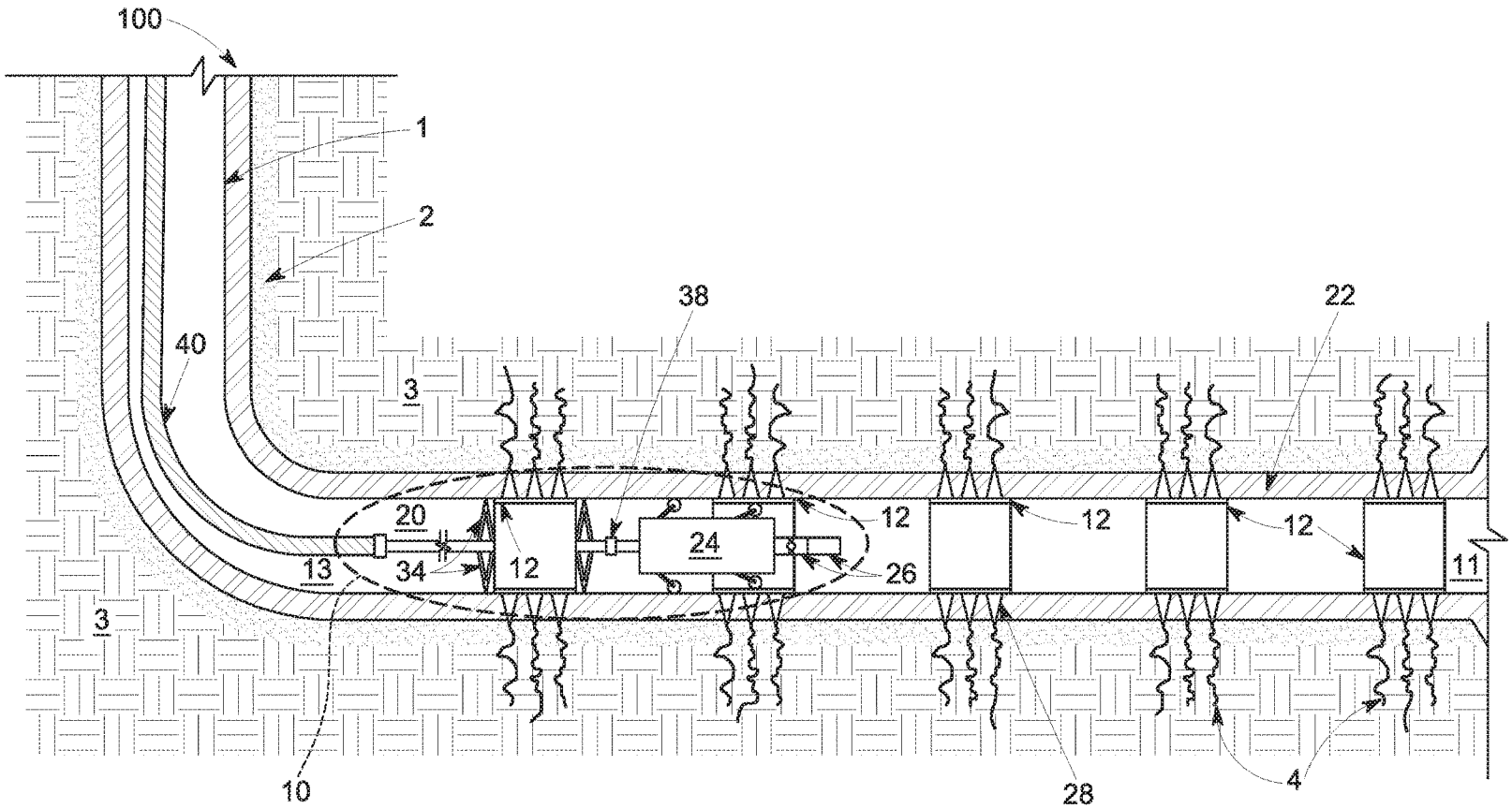

FIG. 12 illustrates an alternate downhole assembly deployment and retrieval protocol used in a perforated well casing according to one or more embodiments of the present invention.

Figure 13:
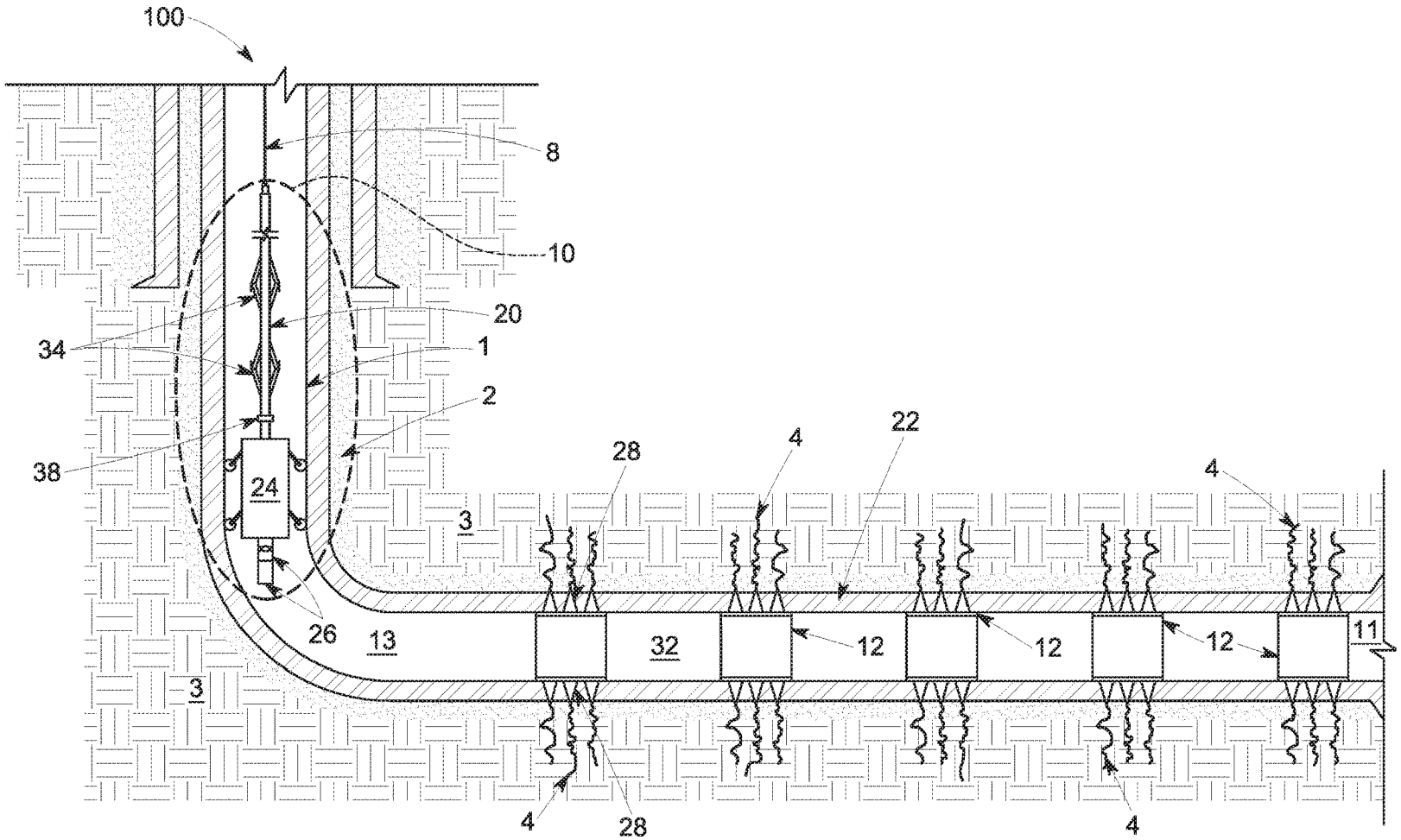

FIG. 13 illustrates a downhole assembly deployment and retrieval protocol used in a perforated well casing according to one or more embodiments of the present invention.

Figure 14:
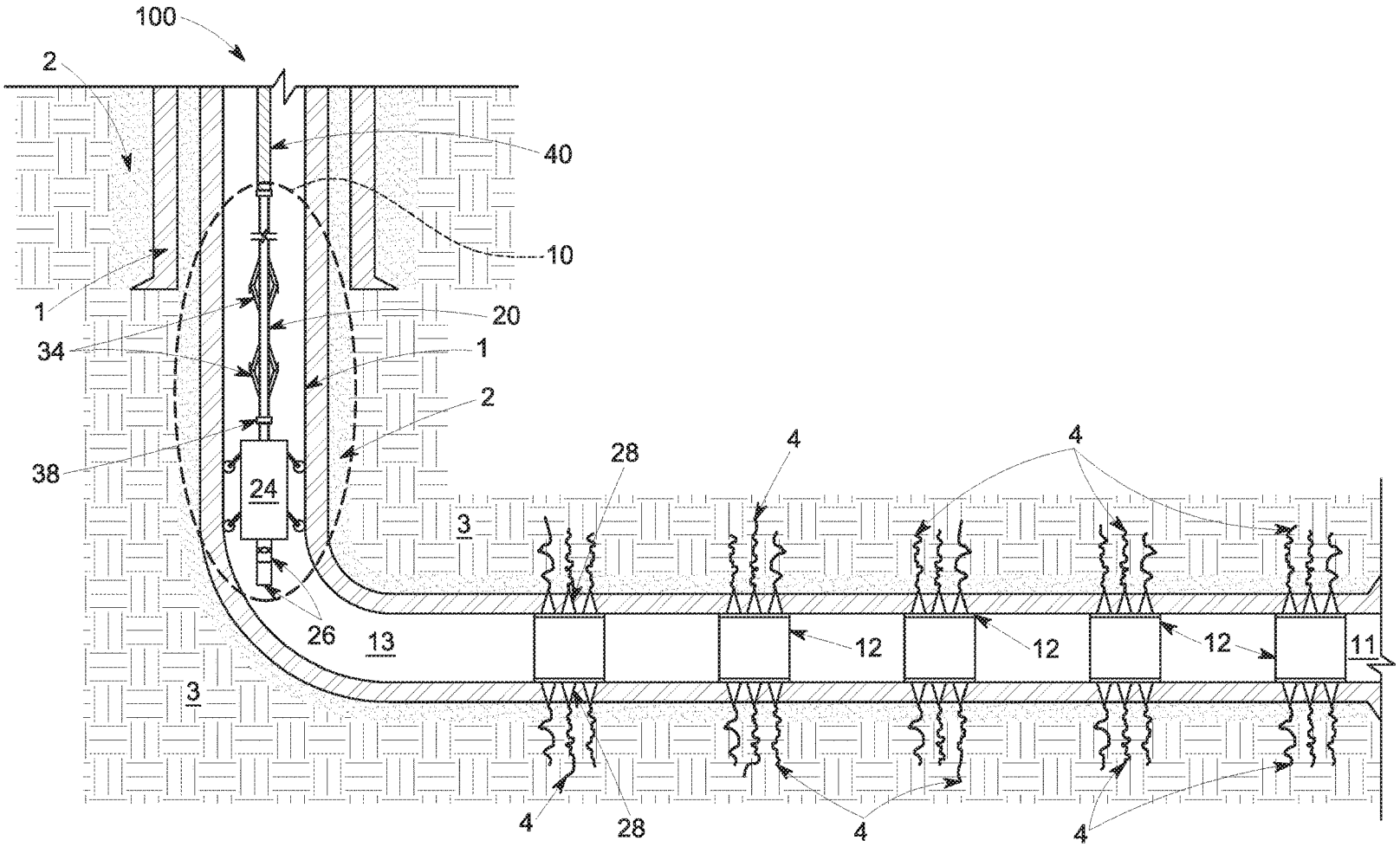

FIG. 14 illustrates an alternate downhole assembly deployment and retrieval protocol used in a perforated well casing according to one or more embodiments of the present invention.

Figure 15:
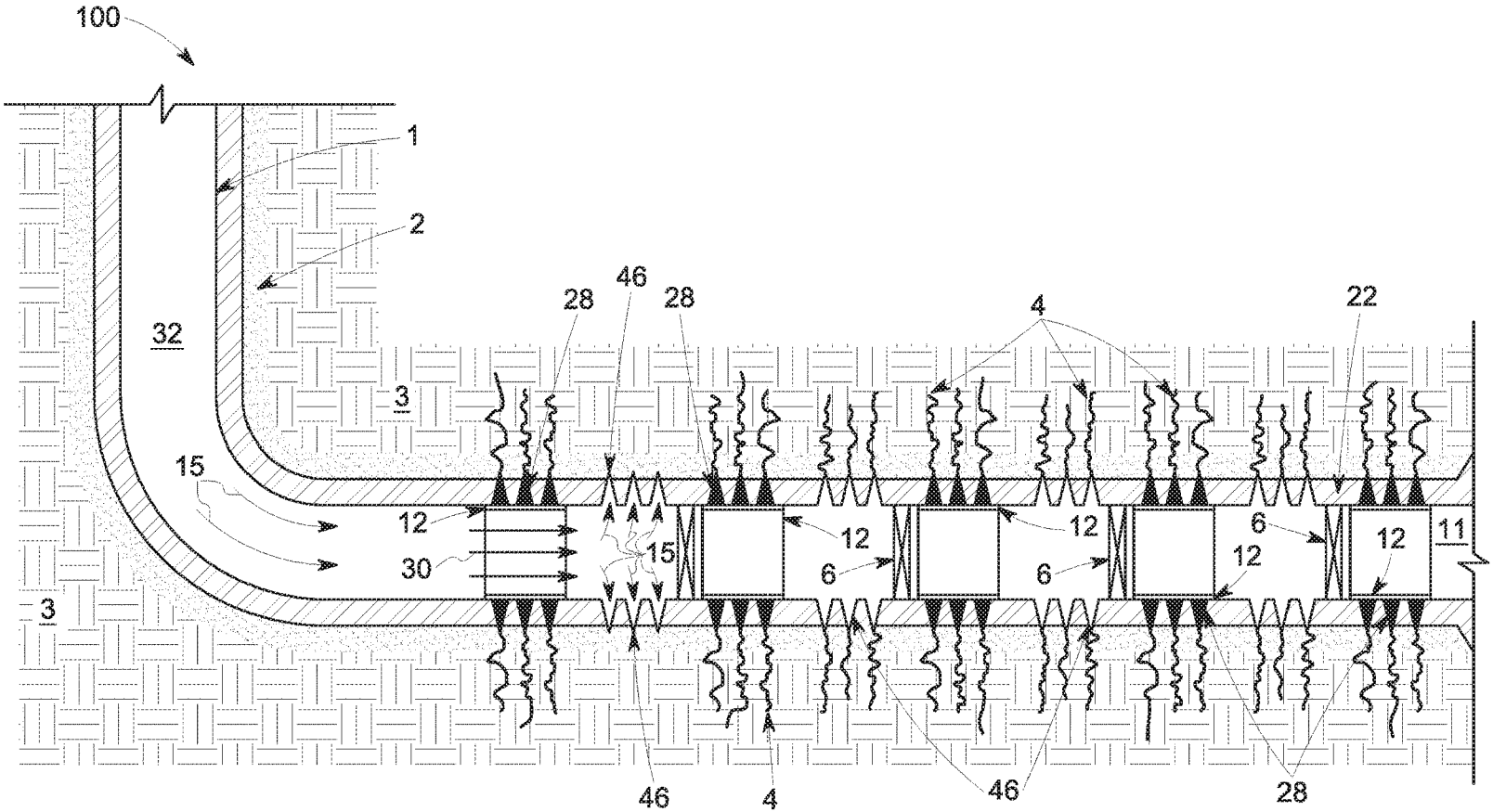

FIG. 15 illustrates a method of restimulating a hydrocarbon-producing well according to one or more embodiments of the present invention.

Figure 16:
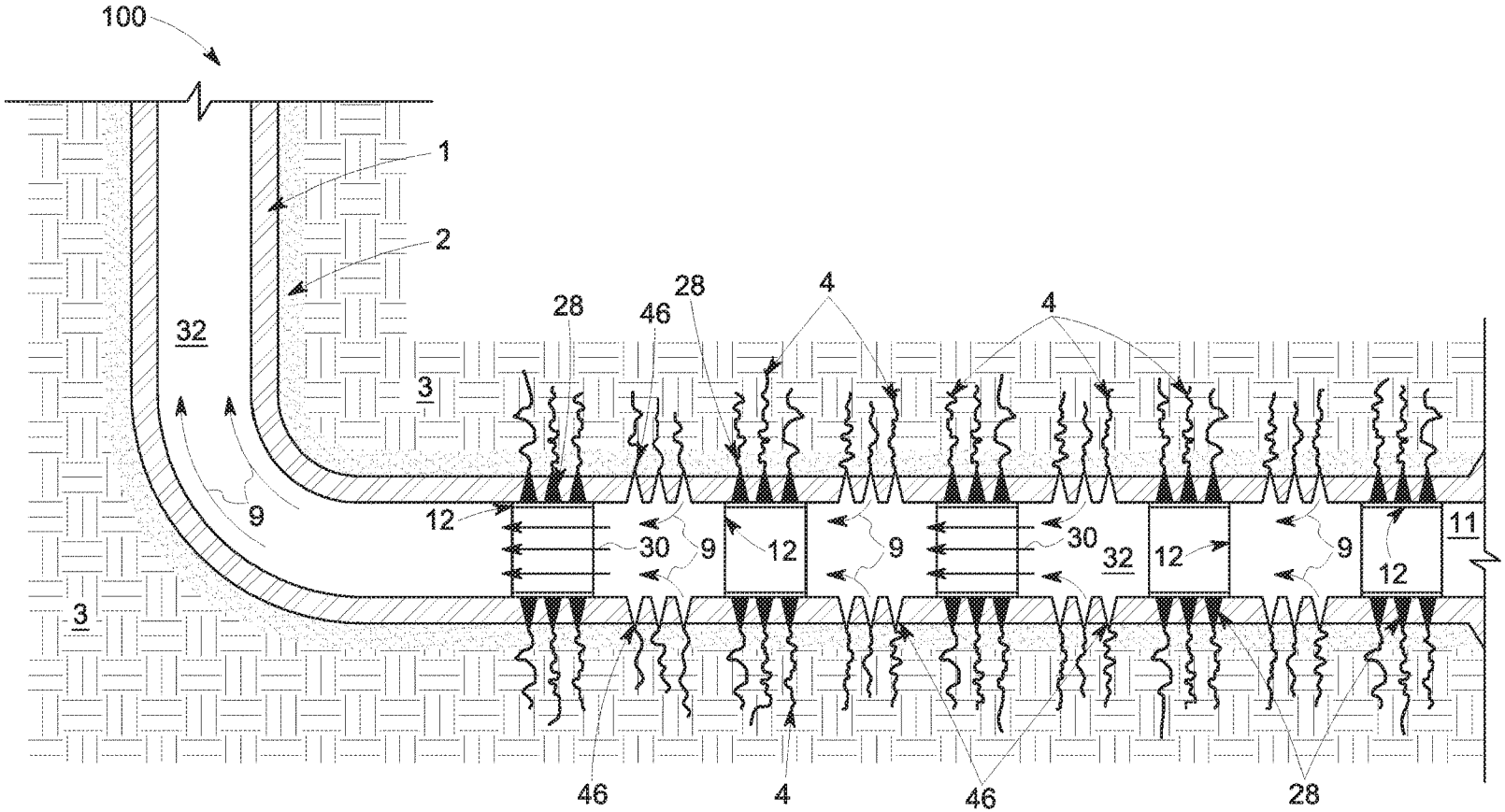

FIG. 16 illustrates a method of restimulating a hydrocarbon-producing well according to one or more embodiments of the present invention.

Figure 17:
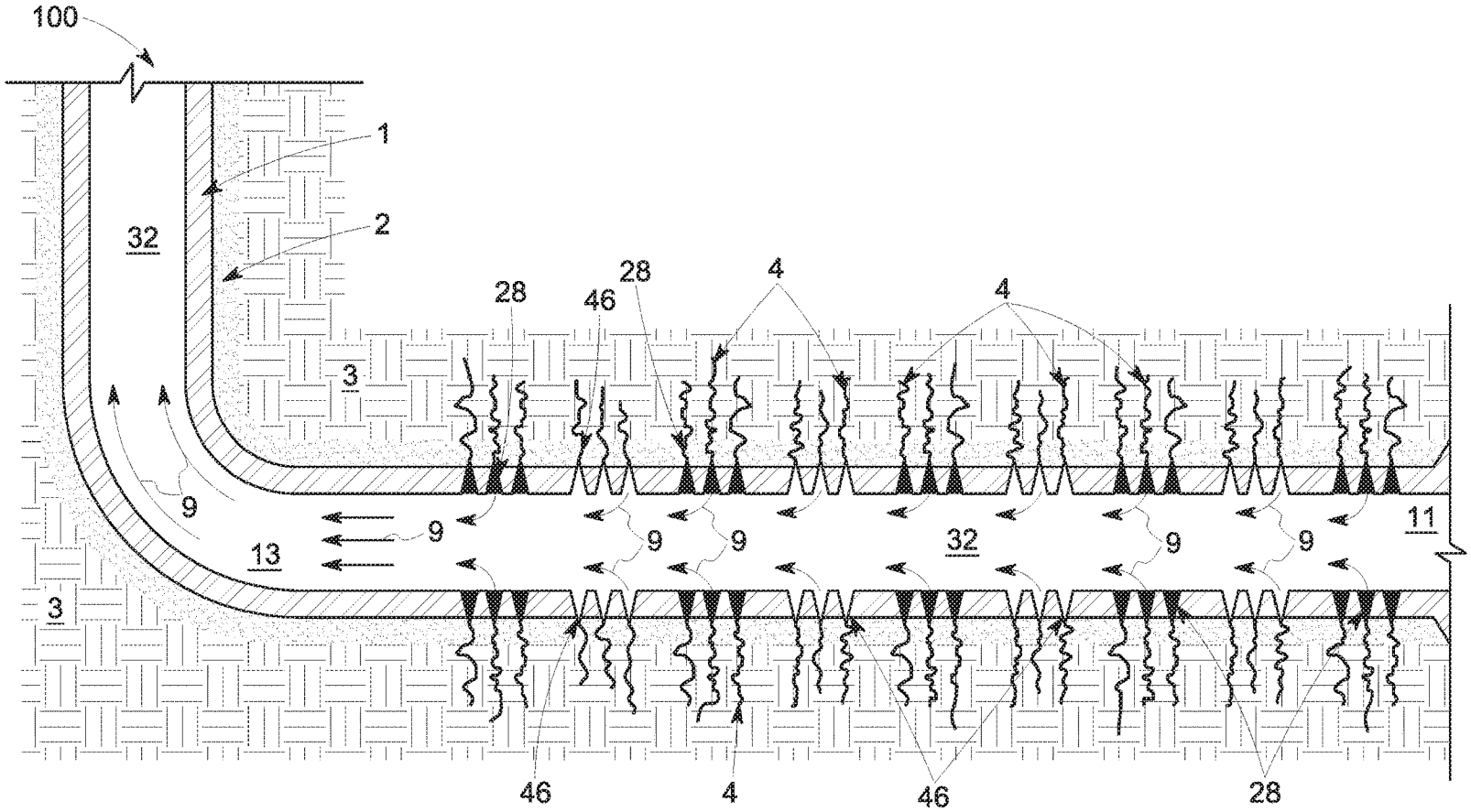

FIG. 17 illustrates a method of restimulating a hydrocarbon-producing well according to one or more embodiments of the present invention.

Figure 18:
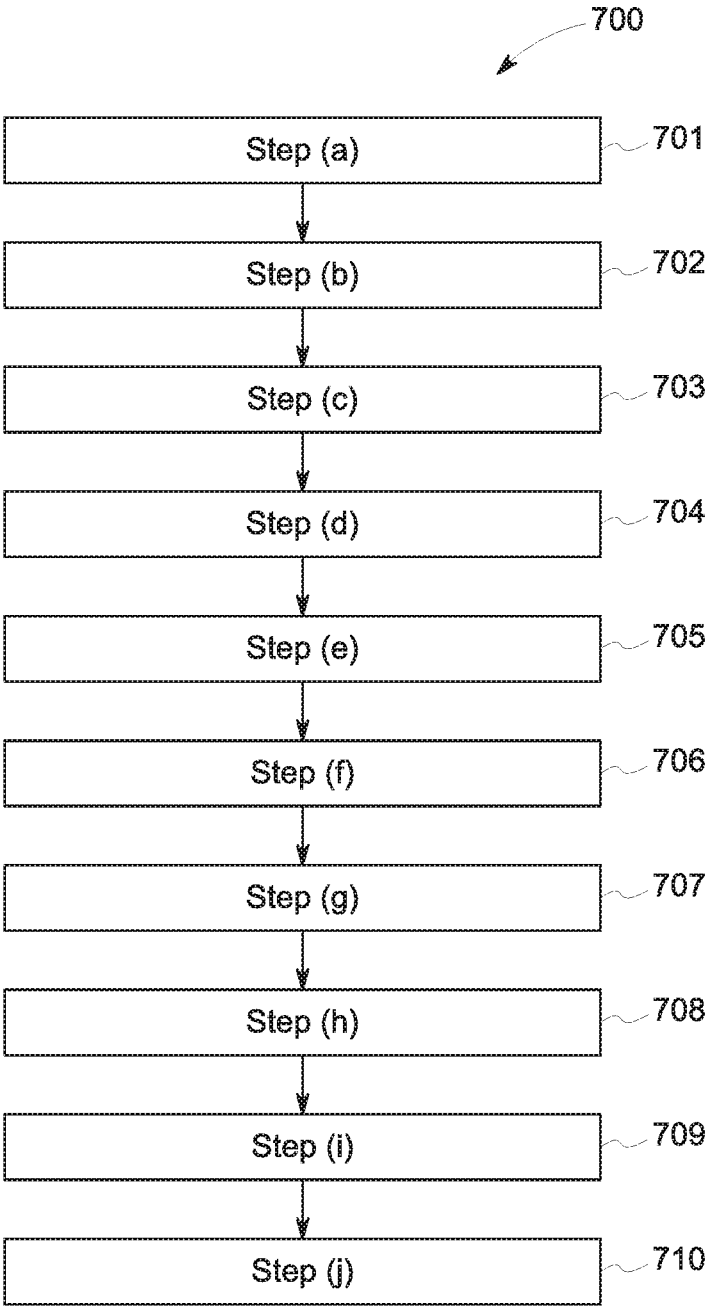

FIG. 18 illustrates a method of restimulating a hydrocarbon-producing well according to one or more embodiments of the present invention.

DETAILED DESCRIPTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The present invention provides systems, methods and devices useful in the restimulation of hydraulically fractured wells. Such restimulation makes it possible to continue to produce valuable reservoir fluids such as gaseous and liquid hydrocarbons as well as useful fluids such as helium and potable water from a previously hydraulically fractured well.

In one or more embodiments the present invention provides a downhole assembly which can be used to efficiently block existing perforations of a well casing of a hydrocarbon production well such that new perforations of the casing can be made at alternate locations within the well and the surrounding formation can be hydraulically fractured from these alternate locations. This restimulation allows for a greater portion of the hydrocarbons trapped within a hydrocarbon reservoir to be recovered, for example. Hydrocarbon reservoirs are at times herein referred to as hydrocarbon-producing formations.

In one or more embodiments the downhole assembly provided by the present invention comprises a plurality of perforation blocking sleeves which may be deployed within a previously perforated well casing at the locations of existing perforation clusters which need to be blocked in order hydraulically fracture the well from additional locations along the wellbore. The perforation blocking sleeves are in one or more embodiments short lengths of pipe sized to fit and move within the well casing and, when deployed over a perforation cluster within the well casing, to be at least coextensive with the perforation cluster along the axis of the well casing. Typically, the perforation blocking sleeve is longer than the perforation cluster it is intended to cover and inhibit fluid flow there-through during a refracturing operation. Perforation clusters typically consist of multiple perforations within a short length (e.g. 3 feet) of the well casing, but may in some embodiments consist of a single perforation of the well casing and yet still qualify as a perforation cluster.

In one or more embodiments, the perforation blocking sleeves attached to a running tool are introduced into the well casing by lowering the assembly through a vertical section of the well, for example on a wireline. At least one running tool driver such as a wireline tractor attached to the running tool itself allows the further deployment of the perforation blocking sleeves within horizontal sections of the well by pulling or pushing the running tool through such well sections. The running tool driver (or drivers) moves each of the perforation blocking sleeves into place over a targeted perforation cluster. In one or more embodiments, the perforation blocking sleeves define a cylindrical interior volume which is open at each end and is at times herein referred to as the flow channel of the perforation blocking sleeve. The running tool is typically cylindrical in shape and is of sufficient length and appropriately sized such that the perforation blocking sleeves may be attached thereupon, the running tool being partially disposed within and traversing the flow channel of each of the perforation blocking sleeves. Running tools used according to one or more embodiments of the present invention may accommodate from two to twenty perforation blocking sleeves. As few as one sleeve and as many as twenty sleeves may be run in on a single trip, with the primary restrictions on number of sleeves per trip imposed by wellbore conditions, surface equipment limitations and running tool driver payload limitations.

In one or more embodiments, the perforation blocking sleeves are reversibly coupled to the running tool, meaning that the perforation blocking sleeve can be uncoupled from the running tool in a downhole environment upon command from a controller, for example a controller at the surface. In one set of embodiment a perforation blocking sleeves can be uncoupled from the running tool within a downhole environment upon a first command from a controller and recoupled to the running tool upon a second command from a controller as when, for example, all or part of the perforation blocking sleeve is to be retrieved from the downhole environment. In an alternate set of embodiments, the perforation blocking sleeves and running tool are configured such that individual perforation blocking sleeves may be uncoupled from the running tool upon command from a controller, however, no provision is made for the recoupling of the perforation blocking sleeve to the running tool while both are deployed downhole. In one or more embodiments, a surface controller linked to the running tool via a communications link associated with a wireline may be used to uncouple the perforation blocking sleeve from the running tool, or alternatively recouple a previously detached perforation blocking sleeve back to the running tool. Whether the surface controller is part of an installation physically linked to the well in which the downhole assembly is being deployed, or is connected only by one or more communications links to the well, such control is defined herein as remotely effecting the uncoupling from, or recoupling to the running tool.

In general, the downhole assembly is configured such that the running tool may be remotely and individually uncoupled from each of the perforation blocking sleeves, meaning that the running tool in a downhole environment may upon an appropriate series of commands from a surface controller be separated sequentially from a plurality of perforation blocking sleeves. Thus, the running tool positions and anchors a first perforation blocking sleeve over a first perforation cluster and detaches from the first perforation blocking sleeve. Thereafter, the running tool positions and anchors a second perforation blocking sleeve over a second perforation cluster and detaches from the second perforation blocking sleeve. Thereafter, the running tool positions and anchors a third perforation blocking sleeve over a third perforation cluster, and so forth. As the foregoing example illustrates, the running tool separates from the perforation blocking sleeves in discrete steps.

As noted, the positioning of the perforation blocking sleeves over their respective perforation clusters is carried out independently, meaning that a first perforation blocking sleeve is positioned over a first perforation cluster where it is anchored in position over the perforation cluster by a first anchoring device and detached from the running tool. This coupling between the running tool and the individual perforation blocking sleeves may be any type of coupling. Suitable couplings include, for example, mechanical couplings, electrical couplings, magnetic couplings, and hydraulic couplings such as are known in the art, which may be used to secure the perforation blocking sleeves to the running tool during their deployment within the well casing. In one or more embodiments, the one or more perforation blocking sleeves are reversibly coupled to the running tool using one or more detention arm assemblies such as are disclosed herein.

As noted, each perforation blocking sleeve is equipped with a first anchoring device with which to secure the perforation blocking sleeve in place following its being positioned over a perforation cluster. The perforation blocking sleeve may comprise one or more of such first anchoring devices which function to prevent a perforation blocking sleeve in position over its respective perforation cluster from moving as it uncoupled from the running tool and/or during withdrawal of the running tool and running tool driver from the flow channel defined by the sleeve. The first anchoring device may be actively deployed in the sense that deliberate actions must be taken in order to deploy the first anchoring device and thereby to inhibit or prevent movement of the perforation blocking sleeve in any direction within the well casing. The first anchoring device may be deployed by any suitable means, for example hydraulically, electrically, by release of stored energy as with a spring-loaded counterpoise device, or by a combination of two or more of the foregoing mechanisms. An exemplary embodiment of such first anchoring devices is provided in the description of FIG. 7 herein.

In one or more embodiments, the downhole assembly comprises one or more expandable members attached to an external surface of the perforation blocking sleeve. The expandable members and perforation blocking sleeves are sized such that the movement of the perforation blocking sleeve into the well is not inhibited by the expandable member in its unexpanded state, however, upon the expandable member being expanded, the perforation blocking sleeve is locked sufficiently securely in place over a perforation cluster to prevent movement of the perforation blocking sleeve during well restimulation by hydraulic fracturing.

The expandable member may be configured as any suitable structure on the outer surface of the perforation blocking sleeve, for example expandable sleeves, expandable O-rings, expandable collars, expandable network structures (e.g., porous screen-like materials and fishnet-like materials) and combinations thereof. Expansion of the expandable member may by triggered on command, or as simply in response to prevailing conditions within the well over time. In one or more embodiments, the expandable member comprises an expandable organic polymer susceptible to expansion upon contact with a polymer-swelling fluid, for example a production fluid such as oil or water. In one or more embodiments, an exogenous fluid is introduced from the surface and contacted with the expandable member to secure it in place within the well.

In one or more embodiments, the expandable member comprises a superabsorbent polymeric material, for example salts and bi-salts of poly acrylic acid and salts and bi-salts polymethacrylic acid. In this embodiment, the superabsorbent polymeric material, dispersed in the nitrile rubber matrix, expands significantly on exposure to water, while nitrile rubber expands minimally on exposure to water. The swelling of the polyacrylate particles causes the elastomer element to swell against the wellbore casing. This sealing mechanism has the advantage of conforming to irregularities in the surface; however, the kinetics of swelling can be slow with some elements taking several days to fully swell. Such elastomer formulations are well-known in the art and are commercially available. In one or more embodiments, the expandable member is configured as a superabsorbent woven fiber such as those offered by $M^2$ Polymer Technologies Inc. and elsewhere.

In one or more embodiments, the expandable member comprises a shape-memory organic polymer which expands when its glass transition temperature is exceeded. Suitable shape memory organic polymers include cross-linked polyurethane as described above. Other possibilities for shape memory polymers suitable for use in downhole conditions include sulfonated poly(etheretherketone) as described in Shi, Y. et al., Macromolecules 2013, 46(10), 4160-4167. Shape memory metal alloys such as Ni—Ti alloys (commonly known as Nitinol) may also be used as part of the sealing system comprising the expandable member. Exogenous fluids may be used in conjunction with shape memory polymers. For example, the expandable member may be composed of a cross-linked polyurethane, optimally formulated for downhole conditions, which undergoes only minimal swelling when exposed to downhole fluids. Pumping of a water/organic solvent mixture, such as water/N-methylpyrrolidone or water/methyl ethyl ketone, allows the organic solvent to penetrate into and swell the polyurethane, effectively lowering the glass transition temperature of the amorphous segment below the bottomhole temperature and thus allowing the material to assume its originally-molded shape. Using an exogenous fluid in this manner is advantageous in that it can allow for better control over the swelling of the sealing element so that the element is not prematurely set in the wellbore, e.g. during conveyance to the target location. The exploitation of the shape memory effect of cross-linked polyurethanes has been described in the literature, for example Jeong, H. M., Journal of Materials Science 2000, 35, 1579-1583.

The strength and durability of the perforation blocking sleeve—perforation cluster interface cluster may be enhanced by the addition of fillers to an organic polymer comprising, or comprised within, the expandable member. For example, ceramic fillers may be used to enhance the resistance of the expandable member to deformation along the well axis. Alternatively, friction enhancing structures such as buttons, slips and die inserts may be advantageously employed. For example, cemented carbide buttons can be embedded in the expandable member such that once the expandable member undergoes expansion, the carbide buttons engage the inner surface of the well casing and improves resistance to slippage of the perforation blocking sleeve within the well casing. Cemented carbide components for this purpose can be sourced from a variety of suppliers, for example Kennametal and CoorsTek. Button, slips and die insert materials may also include powdered metal, ceramic, cast iron, and carburized steel.

In one or more embodiments, the downhole assembly comprises one or more sensors configured to detect perforation clusters within the perforated well casing. This means that the sensor is of a kind suitable for detecting and reporting to a surface controller the position of perforation clusters within the well casing. The sensor may be advantageously located at the leading edge of the downhole assembly. In one or more embodiments, the leading edge of the downhole assembly is that component of the downhole assembly first entering a perforated well section, for example a running tool driver pulling the running tool, perforation blocking sleeves and expandable members into a perforated section of the well. Thus, in one or more embodiments, the running tool driver comprises one or more sensors. In an alternate set of embodiments, the running tool itself comprises one or more sensors appropriately positioned, and capable of detecting perforation clusters. In yet another set of embodiments, one or more of the perforation blocking sleeves comprises one or more sensors appropriately positioned, and capable of detecting perforation clusters. The terms sensor and sensor package may at times herein be used interchangeably.

Suitable sensors for using in detecting perforation clusters within the well casing include casing collar locators, fiber optic sensors, camera sensors and acoustic sensors.

Figure 1:
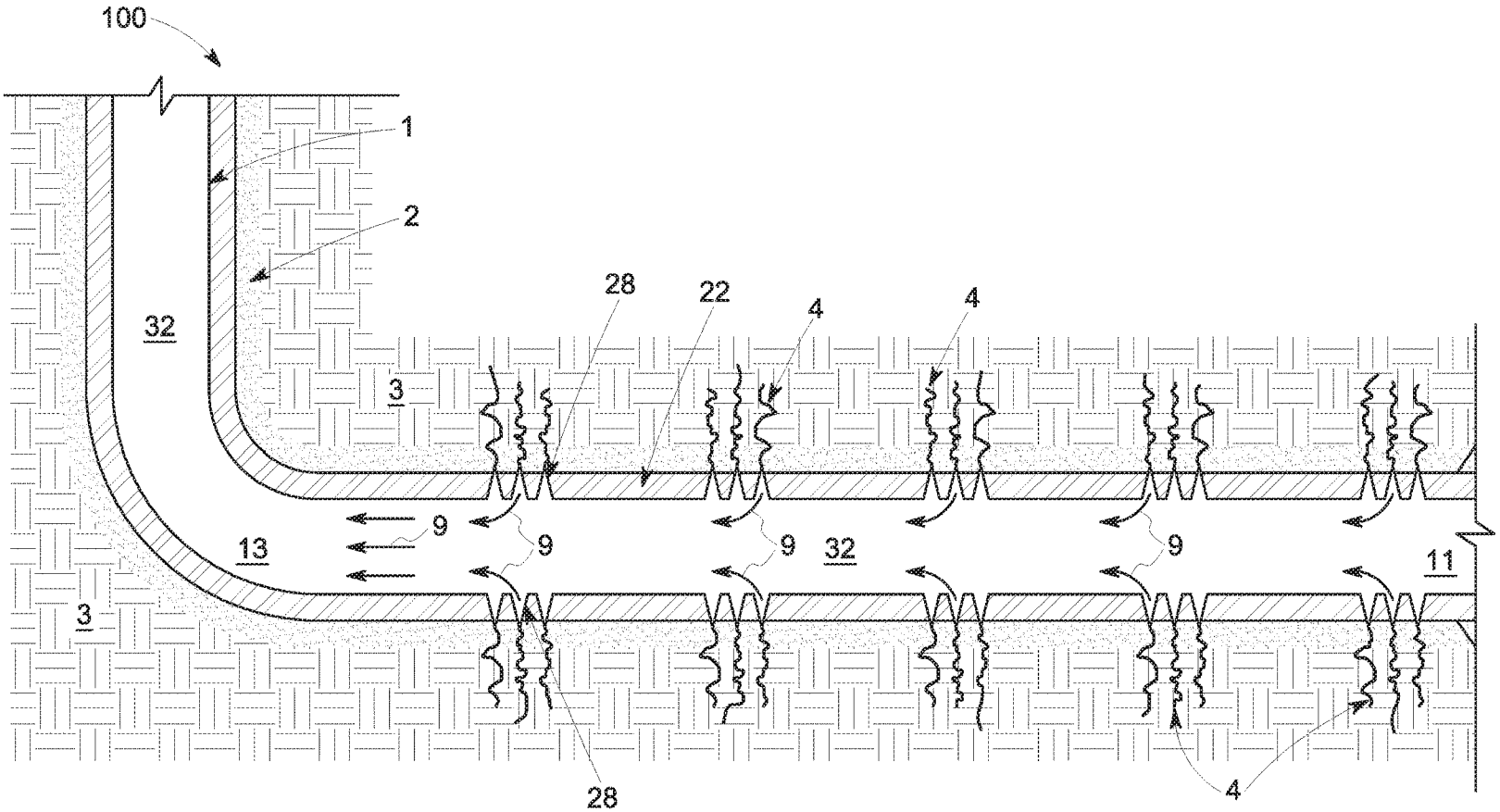
FIG. 1 illustrates a downhole environment wherein one or more embodiments of the present invention may be advantageously utilized.

Turning now to the figures, FIG. 1 illustrates a hydrocarbon producing well 100 having a vertical and horizontal well portions delineated by the vertically oriented well casing 1 and the horizontally oriented perforated well casing 22 which together define the principal flow channel 32 defined by the well casing through which pass production fluids 9 from a hydrocarbon-producing formation 3 en route to a surface handling facility (not shown). Flow channel 32 may at times herein be referred to as the wellbore. In the embodiment shown, perforated well casing 22 includes previously formed perforation clusters 28 within the horizontal section of the well. Perforation clusters 28 penetrate the well casing 22 and well cement 2 enabling hydraulic fracturing of the hydrocarbon-producing formation 3 adjacent the perforation clusters. Formation fractures 4 created by prior hydraulic fracturing enhance the flow rate of production fluids 9 into the flow channel 32 via perforation clusters 28. Unperforated sections of casing 22 between the well toe 11 and well heel 13 represent potential sites for refracturing in order to restimulate the well. As is disclosed herein, effective restimulation of the well requires that preexisting perforation clusters 28 be blocked prior to hydraulic fracturing at other locations within the well during a restimulation protocol.

Figure 2:
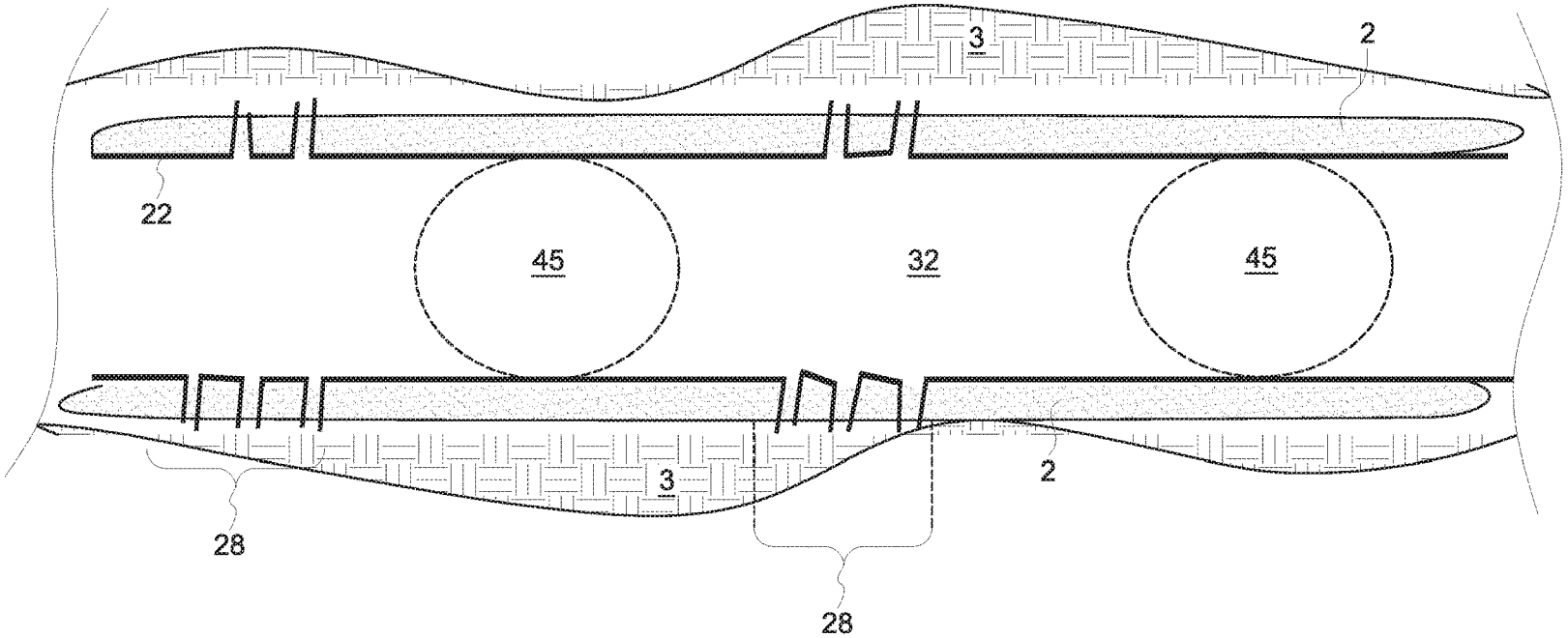
FIG. 2 illustrates a downhole environment wherein one or more embodiments of the present invention may be advantageously utilized.

Referring to FIG. 2, the figure illustrates a portion of a perforated well casing 22 within a hydrocarbon-producing formation 3. New perforation clusters are proposed at locations 45 to contact untapped areas of hydrocarbon-producing formation 3. To effectively stimulate these areas, existing perforation clusters 28 must be blocked prior to hydraulic fracturing treatment through proposed perforation sites 45.

Figure 3:
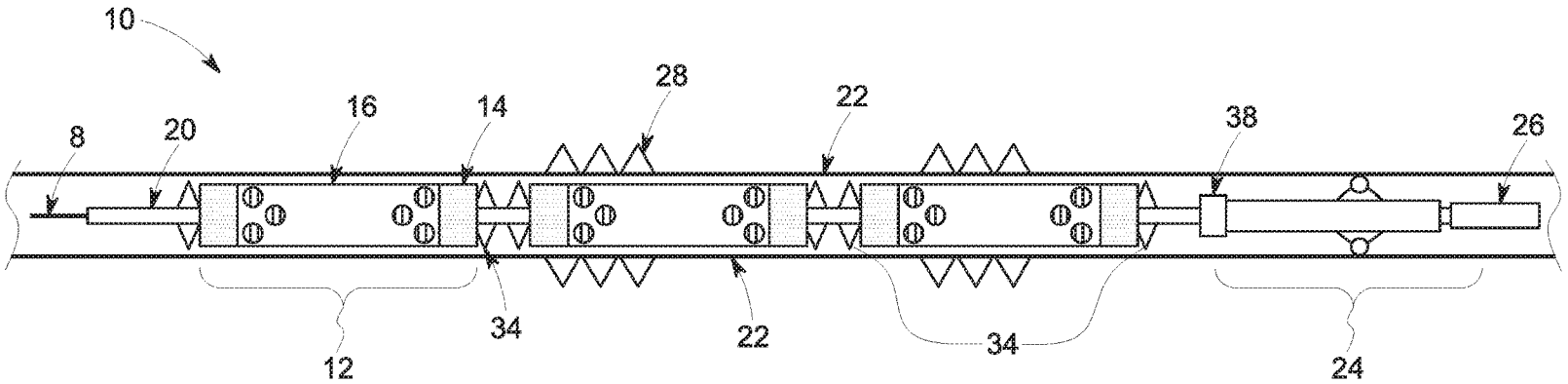
FIG. 3 illustrates a downhole assembly according to one or more embodiments of the present invention.

Referring to FIG. 3, the figure illustrates a downhole assembly 10 according to one or more embodiments of the present invention, the downhole assembly being disposed within a perforated well casing 22 of a hydrocarbon-producing well. In the embodiment shown, the downhole assembly comprises a plurality of perforation blocking sleeves 12 which are attached to a running tool 20. Running tool 20 is in turn coupled to running tool driver 24 at one end and wireline 8 at the end opposite. Wireline 8 may be used to lower the downhole assembly through vertical sections of the well and serves as the power source and communications link between one or more surface controllers (not shown) and the downhole assembly. Power provided to the downhole assembly via the wireline may include either or both of electric power and hydraulic power via appropriate electric and hydraulic cables. Various functionalities within the downhole assembly such as the running tool driver 24, sensor package 26 and mechanical couplings comprising counterpoise energy storage systems may be controlled using one or more of the components of the wireline, for example by one or more of an electric power cable, a hydraulic power cable or a communications cable. In the embodiment shown, the plurality of perforation blocking sleeves 12 are fixed in position on the running tool 20 via retractable detention arm assemblies 34 coupled to the running tool and located at each end of each blocking sleeve. When engaged, detention arm assemblies 34 secure the perforation blocking sleeves in place on the running tool as the downhole assembly travels within the well. The detention arm assemblies may control adventitious movement of the perforation blocking sleeves by establishing a firm connection between the running tool and the perforation blocking sleeve. For example, in one or more embodiments, the detention arm assembly is mechanically joined to the running tool and reversibly attached to one or more of the external surface 18 (See FIG. 6) of the sleeve, the internal surface 19 (See FIG. 4) of the sleeve, the first anchoring device 14 of the sleeve, and combinations thereof. In one set of alternate embodiments, the detention arm assembly is an integral component of the perforation blocking sleeve itself and remains with the sleeve after the running tool and running tool driver are withdrawn from the wellbore. Embodiments in which the detention arm assembly is an integral part of the running tool and is withdrawn from the wellbore with the running tool are believed to be particularly advantageous since exposure of the detention arm assembly to the downhole environment is relatively short and the assembly is readily retrievable with the running tool for reuse. In one or more embodiments, the detention arm assembly is not physically coupled to the perforation blocking sleeve, but secures the perforation blocking sleeves in place by maintaining a fixed position on the running tool until being released as a result of a controller command. Additional details are provided herein (See discussion of FIG. 6 and suite). In the embodiment shown, the running tool driver 24 is coupled to the running tool 20 by a mechanical and electronic connection 38 which supplies electric power to the running tool driver and sensor package 26 while serving as a communications link via the running tool and wireline to one or more controllers. The running tool driver 24 may be a downhole tractor as is well known in the art, or may be a custom built robotic conveyance device. As noted, sensor package 26 is attached to the running tool driver 24 and provides for, inter alia, detection of the locations of existing perforation clusters 28 of the wellbore. The sensor package 26 may advantageously be used to detect other characteristics of interest such as the running tool driver speed and orientation, presence of sand, pooling liquids, adventitious well casing perforations, well casing inside image and dimension, pressure, temperature, flow rate, flow velocity, casing collars, formation resistivity and radioactivity, formation acoustic properties, porosity, permeability, and the like within the well.

Figure 4:
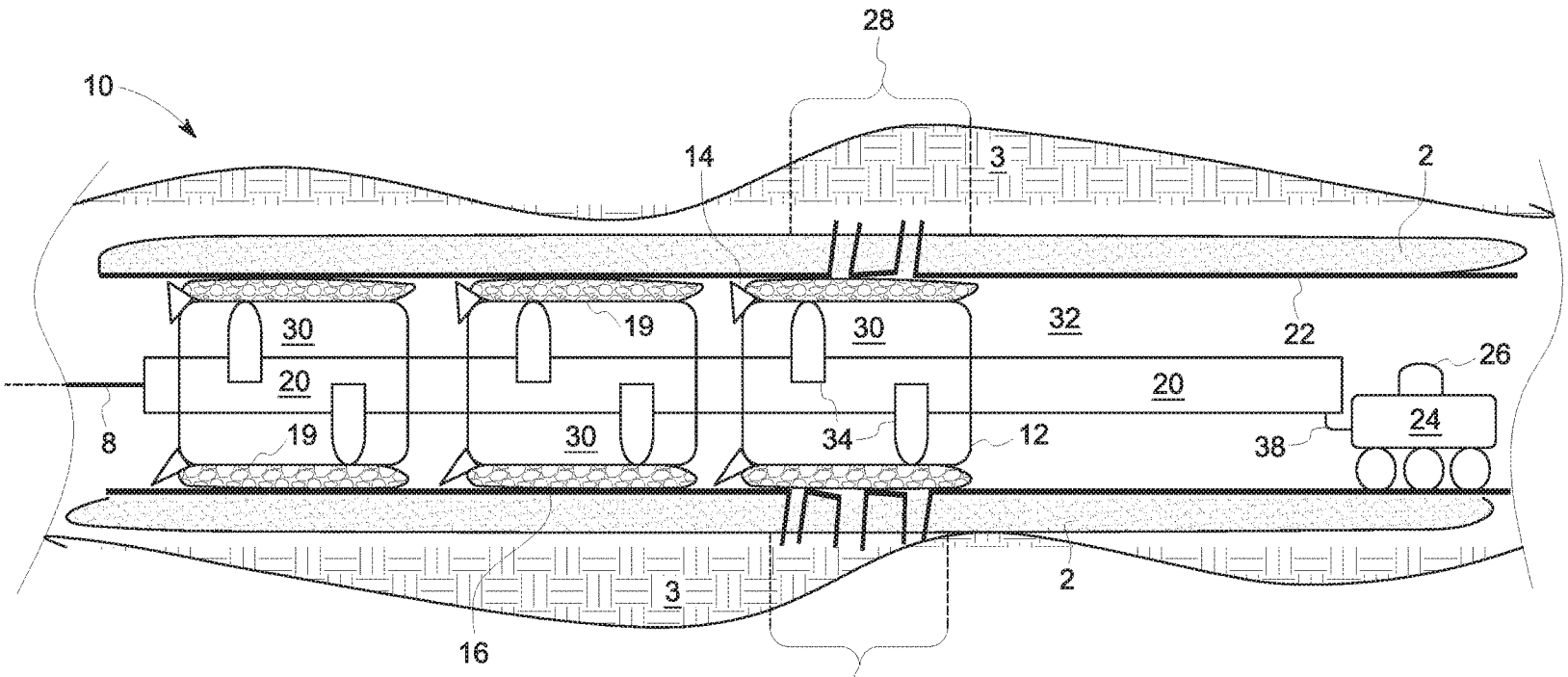
FIG. 4 illustrates a downhole assembly according to one or more embodiments of the present invention deployed within a hydrocarbon-producing well.

Referring to FIG. 4, the figure illustrates a downhole assembly 10 according to one or more embodiments of the present invention comprising a plurality of perforation blocking sleeves 12, the rightmost of which is positioned over perforation cluster 28. Once in position over the perforation cluster the first anchoring devices 14 of this rightmost perforation blocking sleeve are actuated upon one or more commands from a controller and engage the inner surface of the perforated well casing 22 and prevent or inhibit movement of the perforation blocking sleeve from its position over the perforation cluster during disengagement of the running tool detention arm assemblies 34 from the perforation blocking sleeve and during withdrawal of the running tool 20 and running tool driver 24. In the embodiment shown, the detention arm assemblies are configured to engage with the internal surface 19 of the sleeve to fix its position on the running tool. In one or more alternate embodiments, one or more portions of the detention assembly engages with a complementary structure of the sleeve, such as an orifice within a partitioning wall of the sleeve or an enclosure attached to the surface of the sleeve. For example, in one embodiment, the complementary structure is an open ended cylinder configured to engage with and disengage from a cylindrical structure of the detention arm assembly. In the embodiment shown, the detention arm assemblies 34 are positioned partially within the running tool and partially within the flow channel 30 of the perforation blocking sleeve. The detention arm assemblies are configured to be retracted at least partially into the running tool upon being disengaged from the sleeve. Disengagement can be effected by, for example, releasing energy from a counterpoise mechanism energetically coupled to the detention arm assembly. In one or more embodiments, the counterpoise mechanism is a spring released by a controller-actuated locking mechanism, for example a frangible pin. Upon the unlocking of the counterpoise mechanism, energy stored within in the counterpoise mechanism is released and the detention arm assembly is wholly or partially retracted from contact with the perforation blocking sleeve.

Figure 5:
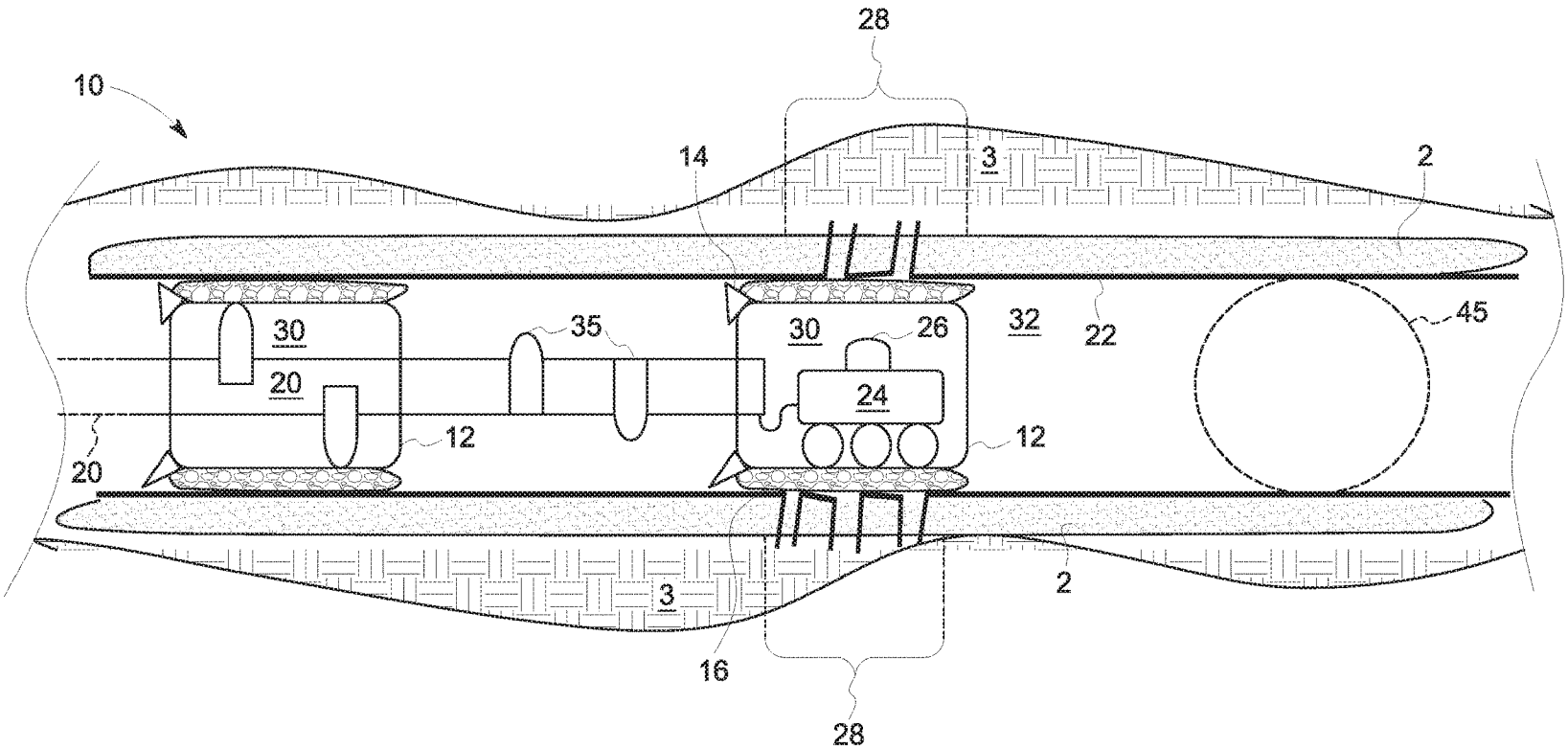
FIG. 5 illustrates a downhole assembly according to one or more embodiments of the present invention following deployment of a first perforation blocking sleeve within a hydrocarbon-producing well.

Referring to FIG. 5, the figure represents the downhole assembly shown in FIG. 4 following disengagement of the detention arm assemblies 34 from the rightmost perforation blocking sleeve 12 and movement of the downhole assembly 10 leftward in the well. Detention arm assemblies no longer in contact with the sleeve are shown as having been partially retracted into the running tool 20 and are indicated by element number 35 to distinguish them from detention arm assemblies engaged with the corresponding perforation blocking sleeve. The embodiment shown illustrates the passage of both the running tool and running tool driver 24 through the flow channel 30 the leftmost perforation blocking sleeve. Running tool driver 24 is shown in the illustrated embodiment as a downhole tractor device equipped with sensor package 26.

Figure 6:
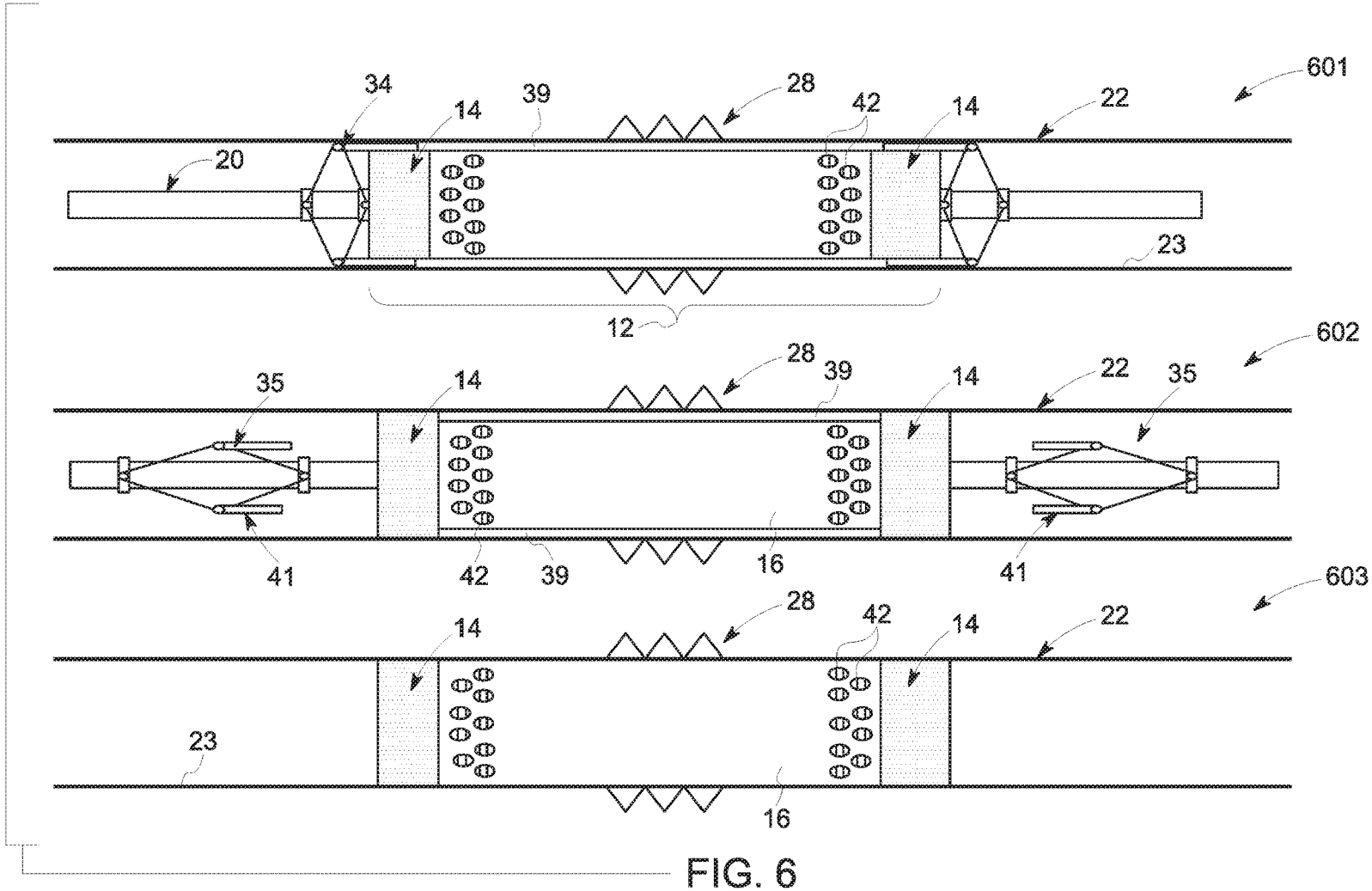
FIG. 6 illustrates the deployment of a perforation blocking sleeve from a downhole assembly according to one or more embodiments of the present invention.

Referring to FIG. 6, the figure illustrates components of a downhole assembly 10 according to one or more embodiments of the present invention and its deployment within a perforated well casing 22. The perforation blocking sleeve 12 is positioned by the running tool 20 over a perforation cluster 28 (See method step 601), and then anchored in place over the perforation cluster using first anchoring device 14 (See method step 602). The perforated well casing is then sealed at that site to prevent or inhibit ingress of formation fluids and egress of hydraulic fracturing fluid. Sealing of the perforated well casing is effected by expanding expandable member 16 into contact with the perforated interior surface of the well casing (See method step 603). In the embodiment shown, the first anchoring device 14 secures the sleeve in position over a perforation cluster 28 in concert with decoupling the sleeve from the running tool 20 by retraction of detention arm assemblies 34. In the embodiment shown, detention arm assemblies 34 are used to maintain the spring-loaded first anchoring device 14 in an energized state while the sleeves are being run into the well aboard the running tool. Upon decoupling of detention arm assemblies 34 from the sleeves, the spring-loaded first anchoring device 14 releases its stored energy and expands through a portion of gap 39 previously occupied by detention arm assembly horizontal member 41 and contacts the inner surface 23 of the perforated well casing. In one or more embodiments, the first anchoring device 14 comprises one or more surface-mounted slips which move radially outward and grip the perforated well casing inner surface to prevent or inhibit axial movement of the sleeve within the well. In one or more alternate embodiments, first anchoring device 14 may comprise a plurality of surface-mounted abrasive pads configured to be brought into contact with the inner surface of the well casing as the first anchoring device moves radially outward following its actuation. Suitable additional anchoring methods include the use of first anchoring devices comprising a plurality of expanding rings, the use of first anchoring devices comprising shape memory metal alloys, the use of first anchoring devices comprising shape memory organic polymers, and the use of first anchoring devices comprising friction enhancing structures disposed within an expandable medium.

Still referring to FIG. 6, in yet another embodiment, first anchoring device 14 may comprise a tapered section of sleeve with a thin cross section that is expanded using a swage mechanism to engage the inner surface of the well casing. The swage mechanism may be actuated using a piston force. In some embodiments such a piston force may also be used to effect the retraction of detention arm assemblies 34. An abrasive or gritty surface may be applied on the outer diameter of the swage section of each blocking sleeve to increase friction at the interface to help prevent movement of the sleeve in the well. Additionally, separate grit-faced slips or die inserts may be incorporated into the tapered section.

Still referring to FIG. 6, and in particular to method step 603, once the first anchoring device 14 has been deployed and the running tool 20 pulled (leftward) through the flow channel 30 of the perforation blocking sleeve, the expandable member 16 may be expanded into contact with the inner surface of the perforated well casing. The purpose of expandable member 16 is to secure the sleeve in position with greater reliability and more effectively seal perforation cluster 28 against fluid egress during a subsequent hydraulic fracturing step. As noted, the expandable member 16 may be an organic polymer that swells to form a seal against the inner surface 23 of perforated well casing 22 either in response to exposure to formation fluids or to exogenous fluids, or in response to prevailing downhole temperature being in excess of a critical temperature at which a shape memory material undergoes a shape transition. In either case, hours or even days may be required to fully expand expandable member 16 and effectively seal the well casing at the perforation cluster. Attachment devices 42 may be embedded or dispersed within the expandable member to provide additional resistance to unwanted motion of the perforation blocking sleeve within the wellbore.

Referring to FIG. 7, the figure illustrates perforation blocking sleeve deployment steps 601-603 shown in FIG. 6 but showing the perforation blocking sleeve first anchoring device 14 and expandable member 16 in cross-section. For clarity, the running tool 20 and most of detention arm assembly 34 are not shown. Detention arm assembly horizontal members 41 are shown at initial deployment step 601, however. Prior to actuation on command by a surface controller, the first anchoring device 14 and expandable member 16 allow sufficient clearance between the outer surfaces of the sleeve components and the inner surface 23 of perforated well casing 22 such that the sleeves can be run into the wellbore, and in particular through the deviated section of the wellbore, with minimal risk of the downhole assembly getting stuck at positions not corresponding to perforation clusters. The gap 39 expressed as an average distance between the outer surface of sleeve 12 and inner surface of the perforated well casing 22 is typically in a range from about 0.25 inches to about 1.0 inches but may be larger in certain embodiments. In one set of embodiments, gap 39 measures on average about 0.5 inches.

Still referring to FIG. 7, once detention arm assemblies 34 are disengaged (See method step 601) from the perforation blocking sleeve 12 (See FIG. 6), the first anchoring device 14 moves radially outward to contact the inner surface 23 of the perforated well casing 22 (See method step 602). In the embodiment shown, this movement occurs as stored energy is released from springs 37 which are integral to the first anchoring device 14. The energy released drives expandable collar 5 of the first anchoring device into contact with the inner surface 23 of the perforated well casing 22. In the embodiment shown, four such spring loaded first anchoring devices are present on the outer surface 18 of sleeve 12. In one or more embodiments, the first anchoring device may be compressed and locked into a compressed state prior to deployment within the well. Suitable locking mechanisms include frangible pins, knobs, collars, hooks and the like which on command from a controller may release the spring. In one or more embodiments, a portion of the spring is disposed within a suitably sized indentation in the outer surface of the sleeve. In one or more embodiments, the spring is bolted and/or welded to either or both of the outer surface 18 and the inner surface 19 of the sleeve. Suitable spring configurations include coil springs inserted into recesses in the sleeve, U- or V-springs wrapped around the circumference of the sleeve, garter springs coiled around the sleeve, wave springs secured to the sleeve, leaf springs secured to the sleeve, and combinations of the foregoing configurations. Spring force may be applied radially, as in the case where spring 37 is a coil spring. Alternatively, spring force may be applied axially, such as in the form of a wave spring, which is converted to radial force by use of a cone or inclined plane mechanism, such as is known in the art with the use of conventional slips used to anchor packers, bridge plugs, and other downhole sealing members to wellbore casing.

Referring to FIG. 8(*a*) and FIG. 8(*b*), the figures show a detailed view of an embodiment of the downhole assembly provided by the present invention focusing on the first anchoring device 14 and its relationship to the detention arm assembly 34. Only one end of the perforation blocking sleeve is depicted, but it will be understood by those of ordinary skill in the art that, with respect to the embodiment shown, both ends of each sleeve may comprise a first anchoring device 14 and accompanying set of detention arm assemblies 34. In FIG. 8(*a*), the detention arm assembly 34 is illustrated as engaged with first anchoring device 14 as required for conveying the perforation blocking sleeves into the wellbore. In this embodiment, first anchoring device comprises slips 36 disposed around the circumference of each end of the sleeve. Slips 36 contain sharp ridges or teeth that bite into the inner surface 23 of the perforated well casing 22 when the first anchoring device is released by the detention arm assembly 34. In one or more embodiments, the perforation blocking sleeve comprises an opposing set of slips on the opposite end of the sleeve (not shown) which prevents sleeve movement towards the toe 13 of the well.

Still referring to FIG. 8(*a*) and FIG. 8(*b*), in the embodiment shown, slips 36 and associated spring assembly 37 are integral to the first anchoring device 14, and first anchoring device 14 is integral to perforation blocking sleeve 12. Thus, by machining the ends of the perforation blocking sleeve similarly to the profile shown in FIG. 8(*b*), each slip element 36 of first anchoring device 14 becomes an energized cantilever spring when compressed by detention arm assembly 34 as shown in FIG. 8(*a*). As a result, the spring force ultimately required to prevent axial motion of the sleeve within the well may be provided by appropriate selection of sleeve dimensions machining, thereby simplifying sleeve design and manufacture.

Still referring to FIG. 8(*a*) and FIG. 8(*b*), the detention arm assembly 34 comprises a plurality of shroud elements 62 which are connected to a series of cantilever arms 61 (FIG. 8(*b*)) which translate motion from an internal piston assembly within running tool 20 to the shroud elements 62. Cantilever arms 61 also serve the purpose of restraining the radial spring force acting on the inner surface 65 of shroud elements 62, and therefore are preferably made of a high-strength steel alloy. Coupling between shroud elements 62 and cantilever arms 61 is achieved via an internal pin connection 64 (See FIG. 10). This connection allows the cantilever arms to freely rotate at the pin. However, the orientation of the shroud elements is restricted due to the presence of circular spring element 63 which has a flat, rectangular cross section. Each shroud element 62 directly couples to a landing area 66 adjacent to slips 36, the landing area being defined by a distal portion of the outer surface 18 of the perforation blocking sleeve 12. Coatings such as poly(tetrafluoroethylene) and variants thereof may be applied using techniques known in the art to the inner surface 65 of shroud element 62 and on the mating surface of landing area 66, to reduce the frictional force that must be overcome by running tool 20 to slide shroud elements 62 from landing area 66 such that detention arm assembly 34 can transition to retracted state 35. Slots 59 milled through running tool mandrel 50 guide the motion of cantilever arms 61 as the internal piston mechanism pushes the detention arm assembly. Circular spring element 63 maintains the retracted configuration 35 of detention arm assembly, as shown in FIG. 8(*b*), once the detention arm assembly has been decoupled from the sleeve.

Still referring to FIG. 8(*a*) and FIG. 8(*b*), simultaneous to the transition of the detention arm assembly into retracted configuration 35 the first anchoring mechanism 14 engages the inner surface 23 of the perforated well casing 22. The deployment of first anchoring device 14 is illustrated by comparison of FIG. 8(*a*) and FIG. 8(*b*). In FIG. 8(*b*), slips 36 are in contact with the inner surface of the perforated well casing. Positive contact is maintained by a restoring force due to deformation of tapered area of the sleeve, which serves as a cantilever spring element 37. Subsequent to the setting of first anchoring device 14, the expandable member 16 is expanded into contact with the inner surface of perforated well casing to seal the perforation cluster.

Referring to FIG. 9(*a*) and FIG. 9(*b*), the figures represent cross-section views of the downhole assembly components shown in FIG. 8(*a*) and FIG. (*b*). In this illustration, the configuration of the cantilever arms 61 and shroud elements 62 around the circumference of the perforation blocking sleeve 12 sleeve can be more thoroughly understood. While this illustration shows eight shroud elements 62 and sixteen associated cantilever arms 61, there are many other possible configurations that may be employed for the same purpose. In FIG. 9(*a*), the extended (or engaged) detention arm assembly 34 restrain slips 36 and spring 37 from contacting the inner surface of perforated well casing 22. In FIG. 9(*b*), the detention arm assembly is in its retracted (or disengaged) state 35 while slips 36 are in contact with the inner wall of the perforated well casing. Comparing FIG. 9(*a*) and FIG. 9(*b*), it can be seen that shroud elements 62 must be shaped and sized appropriately to accommodate the transition of detention arm assembly 34 from its engaged state (See FIG. 9(*a*)) into its engaged state 35 shown in FIG. 9(*b*). Importantly, shroud elements 62 must contract into a smaller diameter than the diameter of the inner surface 19 of perforation blocking sleeve 12 such that the running tool assembly 20 and retracted detention arm assembly 35 may be pulled through the flow channel 30 of the perforation blocking sleeve without disturbing the perforation blocking sleeve from its proper position over a perforation cluster.

Referring to FIG. 10, the figure represents a side-on view of perforation blocking sleeve 12 and running tool 20 components of a downhole assembly according to one or more embodiments of the present invention. In the embodiment shown, the running tool 20 comprises an internal piston mechanism which may be used to deploy a first anchoring device of a perforation blocking sleeve. Detention arm assembly 34 is shown as engaged with and restraining the outward expansion of an appropriately machined end section of the perforation blocking sleeve constituting the first anchoring device. (See perforation blocking sleeve portion designated cantilever spring 37 comprising and adjacent to landing area 66 and slips 36.) Running tool assembly 20 comprises a running tool mandrel 50 which contains spring 49 configured to set a piston 53 in motion on command from a controller. Seals 58 are disposed around the internal and external surfaces of piston 53 to ensure a reproducible translation force of piston 53. Spring 49 is compressed (energized) at the surface prior to the downhole assembly being deployed downhole. The spring is restrained by one or more frangible connection pins 60 which are designed to shear and allow motion of the spring under specified conditions. Frangible pin 60 is threaded or otherwise inserted into inner conduit housing 48, which is contained within running tool mandrel 50. The seals 58 at the inner surface of piston 53 contact the outer surface of conduit housing 48. The annulus 51 between the conduit housing 48 and running tool mandrel 50 is configured to accommodate piston 53 and spring 49. When the frangible connection pin 60 is sheared, spring 49 expands and piston 53 translates while running tool mandrel 50 and conduit housing 48 remain stationary.

Still referring to FIG. 10, frangible connection pin 60 is sheared on command by means of direct electrical connection between a wireline connected to a power source at the surface and the running tool 20. In one embodiment, a first specific current pulse is used to actuate the frangible connection pin or pins of a single properly positioned perforation blocking sleeve among a plurality of perforation blocking sleeves being deployed in sequence from the running tool. This first specific current pulse activates electronics (not shown) in the perforation blocking sleeve of interest which generate sufficient heat within the pin or adjacent to it to cause the pin to fail and release the spring 49 and set piston 53 in motion. In one or more embodiments, each frangible connection pin 60 comprises a pin component made of a soft metal such as copper or tin which is heated in response to passage of electric current through it. This allows the force stored within spring 49 to overcome the shear strength of the pin(s), to drive piston 53 and the cantilever arms 61 of detention arm assembly 34, and ultimately to engage slips 36 of first anchoring device 14 with the inner surface of the perforated well casing, thereby securing the perforation blocking sleeve over a perforation cluster. A second, third and fourth specific current pulse may be used to actuate the first anchoring devices of the second, third and fourth perforation blocking sleeves in proper sequence. Alternative methods for releasing the stored energy in the spring 49 include switching an embedded solenoid valve to release the spring, the use of electroactive shape memory spring-detaining components which become spring-releasing components under the influence of an electric field, for example pin components comprising one or more electroactive shape memory polyurethane composites, or the use of current to generate heat to activate a spring-detaining component comprising one or more shape memory metal alloys.

Still referring to FIG. 10, piston 53 and cantilever arms 61 are directly coupled by a connection 56 on the outer surface of the piston. In one or more embodiments, two cantilever arms 61 are attached by the same pin connection 64 to each shroud element 62, while the same two cantilever arms are attached by independent connections to piston 53. Initially, when piston 53 begins to move, each pair of cantilever arms 61 move in tandem. However, as the arms 61 and piston 53 translate, one set of cantilever arms engages internal profile 57 machined into the inner surface of mandrel 50, which restricts the translational motion of one of each pair of the cantilever arms 61 while allowing the other arm in each pair to translate down the length of slots 59. This restriction creates a scissor-like motion centered at pin connection 64 between shroud element 62 and cantilever arm 61, which promotes the radial contraction of detention arm assembly 34 as illustrated most clearly by FIG. 9(*a*) and FIG. 9(*b*). Cantilever arms 61 extend through slots 59 in the running tool mandrel 50, which guide the translational motion of arms 61. As the piston translates in the direction of the heel of the well 13 as illustrated in this figure, the detention arm assembly 34 transitions to retracted state 35, and first anchoring device 14 is actuated causing slips 36 to engage the inner wall of the perforated well casing 23, thus securing sleeve 12 in place within the well.

Referring to FIG. 11, the figure illustrates a downhole assembly 10 and one or more steps of a method of restimulating a well according to one or more embodiments of the present invention. In the embodiment shown, a plurality of perforation blocking sleeves 12 reversibly coupled to a running tool 20 are introduced into and deployed within a perforated well casing 22 of a previously hydraulically fractured well on a single trip of the downhole assembly 10 into the well. The downhole assembly 10 is loaded at the surface with multiple perforation blocking sleeves 12 and lowered into the vertical section 1 of the well. In the embodiment shown, running tool 20 and running tool driver 24 are depicted as having traveled through the vertical section 1 of the well and into the perforated section of the well, denominated perforated well casing 22. Sensors 26 positioned adjacent to the running tool driver provide location and position of the downhole assembly 10 and the positions of perforation clusters 28. The functional coupling 38 between the running tool driver 24 and running tool 20 allows the data from sensor 26 to be transmitted to the surface through the wireline 8, and mechanically couples the running tool driver to the running tool. The detention arm assemblies 34 on the running tool 20 secure the sleeves 12 in place on the running tool. The downhole assembly 10 is positioned within the perforated well casing 22 such that the first sleeve 12 is positioned over the first perforation cluster 28. Typically, this means the rightmost perforation blocking sleeve shown in the figure and the corresponding perforation cluster 28 closest to the well toe 11 and furthest away from the well heel. The sleeves are sequentially set in place moving from the toe of the well towards the heel of the well 13, which is understood in the art to be proximate to a transition section in the well in which the wellbore trajectory transitions from vertical to horizontal. In the embodiment shown, three of the five perforation blocking sleeves are depicted as fully disengaged from the running tool 20 of the downhole assembly 10, one perforation blocking sleeve is shown as partially disengaged from the running tool, and the leftmost perforation blocking sleeve is depicted as still attached to the running tool 20 and thus still engaged to the downhole assembly.

Referring to FIG. 12, the figure illustrates a downhole assembly 10 and one or more steps of a method of restimulating a well according to one or more embodiments of the present invention. The downhole assembly 10 is essentially the same as in FIG. 11 but a jointless pipe 40 is shown as the conveyance tool through the vertical section of the well instead of wireline 8. Like the wireline depicted in FIG. 11, the jointless pipe also serves as both a power and communications link between the surface and the downhole assembly. Jointless pipe may be coiled tubing as is well known in the art. Jointless pipe 40 may be of sufficient stiffness as to eliminate the need for running tool driver 24 to convey the plurality of sleeves 12 into the desired location within the wellbore. In such instance, the jointless pipe itself serves as the running tool. Thus in one or more embodiments, the running tool driver is a jointless pipe.

Referring to FIG. 13 and FIG. 14, the figures illustrate a downhole assembly 10 and one or more steps of a method of restimulating a well according to one or more embodiments of the present invention. In the embodiments shown, the downhole assembly has positioned and anchored each of the plurality of perforation blocking sleeves 12 in place within the perforated well casing 22 such that all of the perforation clusters 28 of the well are either partially or fully occluded depending on the degree to which the expandable member 16 (not shown) has expanded, and the running tool 20 (minus the perforation blocking sleeves), running tool driver 24 and sensor package 26 have been hoisted into the vertical section 1 of the well on a wireline 8 (FIG. 13) or on a j ointless pipe 40 (FIG. 14).

Referring to FIG. 15, the figure illustrates one or more steps of a method of restimulating a well according to one or more embodiments of the present invention. In the embodiment shown, the downhole assembly has positioned and anchored each of the plurality of perforation blocking sleeves 12 in place within the perforated well casing 22 such that all of the perforation clusters 28 of the well are either partially or fully occluded depending on the degree to which the expandable member 16 (not shown) has expanded. The figure illustrates a point during the method in which a series of new perforation clusters 46 have been created and a corresponding number of fracturing plugs 6 have been deployed. The process of setting in place the fracturing plugs 6, creating the new perforation clusters 46 and hydraulically fracturing the formation 3 via the new perforation clusters is advantageously carried out stepwise. On each trip downhole by the tool used to create the new perforation clusters 46 and deploy the fracturing plugs in the perforated well casing, one fracturing plug 6 is set, and at least one new perforation cluster 46 is created. The tool is removed from the perforated well casing 22 and fracturing fluid 15 is pumped into the well. The fracturing fluid flows through the flow channels 30 of upstream perforation blocking sleeves and out through one or more new perforation clusters 46 located within a length of perforated well casing between two of the deployed perforation blocking sleeves 12 and into formation 3 creating new formation fractures 4. This sequence is repeated for as many stages as required. In the embodiment shown, the last in a sequence of four hydraulic fracturing steps is being carried out.

Still referring to FIG. 15, fracturing plugs 6 and their use in hydraulic fracturing are well-known in the art. Such plugs are used during initial hydraulic fracturing treatments to isolate perforation clusters 28/46 in a given fracturing sequence. Fracturing plugs 6 must be appropriately sized such that there is adequate clearance between the inner surface of sleeve 12 and the outer surface of each plug 6. New perforation clusters 46 are created using perforating guns as are known in the art. Both perforating guns and fracturing plugs 6 may be conveyed into the wellbore using the same wireline 8 as used to convey downhole assembly 10 for deployment of blocking sleeves 12.

Referring to FIG. 16, the figure illustrates one or more steps of a method of restimulating a well according to one or more embodiments of the present invention. In the embodiment shown, all fracturing plugs 6 have been removed from the wellbore. Removal of the fracturing plugs may be effected by, for example, degradation by exposure to one or more fluids in the well, by milling and other suitable techniques known in the art. Once the plurality of fracturing plugs have been removed from the wellbore, production fluid 9 flows from the formation 3 through the formation fractures 4 and new perforation clusters 46 into the well casing flow channel 32 and blocking sleeve flow channels 30, and up to the surface. In one or more embodiments, production fluids are artificially lifted to the surface. In one or more alternate embodiments, production fluids flow unassisted to the surface.

Referring to FIG. 17, the figure illustrates one or more steps of a method of restimulating a well according to one or more embodiments of the present invention. In the embodiment shown, the perforation blocking sleeves 12 have been removed from the wellbore either partially or entirely, exposing old perforation clusters 28 to the well casing flow channel 32. Perforation blocking sleeves 12 may be dissolved or degraded sufficiently by employing reactive metal and polymer components in the construction of the sleeves. Once perforation blocking sleeves 12 have been removed from the well, production fluid 9 flows through the formation 3 into formation fractures 4 and into old perforation clusters 28 and new perforation clusters 46, and into the well casing flow channel 32 and up to surface.

Referring to FIG. 18, the figure represents a method of restimulating a well according to one or more embodiments of the present invention. In a first method step (a) 701, a running tool driver linked to a running tool are introduced into a perforated well casing within a wellbore of a previously hydraulically fractured hydrocarbon-producing formation. A plurality of perforation blocking sleeves are reversibly coupled to the running tool. One or more expandable members are secured to an outer surface of each of the perforation blocking sleeves, and each perforation blocking sleeve defines a flow channel in fluid communication with a principal flow channel defined by the perforated well casing. In a second method step (b) 702, a sensor operationally linked to the running tool is used to locate a first perforation cluster. The term operationally linked to the running tool means that the sensor moves within the perforated well casing in concert with the running tool. The sensor may be disposed on, or disposed within, any suitable component or components of the downhole assembly. In a third method step (c) 703, a first perforation blocking sleeve is positioned by the running tool over the first perforation cluster. In various embodiments, the running tool driver pulls or pushes the running tool to properly align the first perforation blocking sleeve with the targeted first perforation cluster. A surface controller causes the running tool driver to move the running tool and perforation blocking sleeve into position relative to the perforation cluster. In a fourth step (d) 704, a first anchoring device is deployed and secures the first perforation blocking sleeve over the first perforation cluster. In one or more embodiments, this first anchoring device is an integral part of the perforation blocking sleeve. In a fifth step (e) 705, the first perforation blocking sleeve is remotely uncoupled from the running tool. For example, a controller at the surface actuates a component of the running tool, say a compressed spring, to sever a mechanical connection between the running tool and the first perforation blocking sleeve. In a sixth method step (f) 706, the running tool is retracted through the flow channel of the first perforation blocking sleeve. This is done in preparation for the deployment of the second perforation blocking sleeve over the second perforation cluster and so forth until all of the plurality of perforation blocking sleeves have been deployed over a corresponding perforation cluster. In one or more embodiments, retraction of the running tool through the flow channel of a perforation blocking sleeve causes a running tool driver to be retracted through the perforation blocking sleeve in concert with the movement of the running tool, although the running tool will precede or follow the running tool driver through the perforation blocking sleeve flow channel during such retraction, depending on the nature (push or pull) of the running tool driver. In a seventh method step (g) 707, steps (b)-(f) are repeated until all of the plurality of perforation blocking sleeves have been deployed over and secured to a corresponding perforation cluster; the first perforation blocking sleeve deployed over and secured to the first perforation cluster, the second perforation blocking sleeve deployed over and secured to the second perforation cluster, and so forth. In an eighth method step (h) 708, the one or more expandable members attached to the outer surface of each of the perforation blocking sleeves are expanded sufficiently to effectively limit fluid flow through the perforation clusters. In a ninth method step (i) 709, one or more new perforation clusters are created in the perforated well casing. In a tenth method step (j) 710, the hydrocarbon-producing formation is hydraulically fractured via the one or more new perforation clusters. In one or more embodiments, the method further comprises a step (k) in which one or more of the expandable members expanded in step (h) are solubilized to allow one or more of the perforation blocking members to be removed from the perforated well casing. In one or more embodiments, the method further comprises a step (l) in which the perforation blocking sleeve is solubilized.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A downhole assembly for use in well restimulation comprising:

(a) a plurality of perforation blocking sleeves each comprising a first anchoring device;

(b) one or more expandable members secured to an external surface of each of the perforation blocking sleeves;

(c) a running tool for transporting the plurality of perforation blocking sleeves and expandable members within a perforated well casing;

(d) a running tool driver for moving the running tool, perforation blocking sleeves and expandable members within the perforated well casing; and (e) one or more sensors configured to detect perforation clusters within the perforated well casing;

wherein the first anchoring device secures each perforation blocking sleeve over a perforation cluster within the perforated well casing, each perforation blocking sleeve defining a flow channel in fluid communication with a principal flow channel defined by the well casing;

wherein the running tool is remotely and individually uncoupled from each of the perforation blocking sleeves; and wherein the running tool and the running tool driver are retractable through the flow channel of each the perforation blocking sleeves.

2. The downhole assembly according to claim 1, wherein the expandable member comprises a material comprising an organic polymer susceptible to expansion by contact with either or both of an exogenous fluid and a production fluid within the perforated well casing.

3. The downhole assembly according to claim 2, wherein the production fluid is water and the expandable member comprises a superabsorbent material.

4. The downhole assembly according to claim 1, wherein the running tool is reversibly coupled to the perforation blocking sleeves via one or more detention arms.

5. The downhole assembly according to claim 1, wherein the running tool driver is a tractor coupled to the running tool.

6. The downhole assembly according to claim 1, wherein the running tool driver is a jointless pipe coupled to the running tool.

7. The downhole assembly according to claim 1, wherein the running tool driver comprises the one or more sensors configured to detect a perforation cluster.

8. The downhole assembly according to claim 1, wherein the running tool comprises the one or more sensors configured to detect a perforation cluster.

9. The downhole assembly according to claim 1, wherein one or more perforation blocking sleeves comprises the one or more sensors configured to detect a perforation cluster.

10. The downhole assembly according to claim 1, comprising at least one sensor selected from the group consisting of casing collar locators, fiber optic sensors, camera sensors and acoustic sensors.

11. The downhole assembly according to claim 1, wherein the expandable member comprises a shape-memory organic polymer which expands when its glass transition temperature is exceeded.

12. The downhole assembly according to claim 11, wherein the expandable member further comprises one or more attachment devices for further inhibiting movement of the perforation blocking sleeve once detached from the running tool.

13. The downhole assembly according to claim 12, wherein said attachment devices are selected from the group consisting of buttons and slips.

14. A method of restimulating a well, the method comprising:

(a) introducing into a perforated well casing within a previously hydraulically fractured hydrocarbon-producing formation a running tool driver, a running tool to which are reversibly coupled a plurality of perforation blocking sleeves, and one or more expandable members secured to an external surface of each of the perforation blocking sleeves, each perforation blocking member defining a flow channel in fluid communication with a principal flow channel defined by the well casing;

(b) locating a first perforation cluster using one or more sensors operationally linked to the running tool;

(c) positioning a first perforation blocking sleeve over the first perforation cluster;

(d) deploying a first anchoring device to secure the first perforation blocking sleeve over the first perforation cluster;

(e) remotely uncoupling the first perforation blocking sleeve from the running tool;

(f) retracting the running tool through the flow channel of the first perforation blocking sleeve;

(g) repeating steps (b)-(f) until each of the plurality of perforation blocking sleeves is secured over a respective perforation cluster and the running tool and running tool driver have been retracted through the flow channel of a last perforation blocking sleeve;

(h) expanding the one or more expandable members to effectively inhibit fluid flow through the perforation clusters;

(i) creating one or more new perforation clusters in the well casing; and (j) hydraulically fracturing the hydrocarbon-producing formation via the one or more new perforation clusters.

15. The method according to claim 14, wherein the expandable member comprises an organic polymer susceptible to expansion by contact with either or both of an exogenous fluid and a production fluid within the perforated well casing.

16. The method according to claim 14, wherein the production fluid is water and the expandable member comprises a superabsorbent polyacrylate.

17. The method according to claim 14, wherein the running tool is reversibly coupled to the perforation blocking sleeves via one or more detention arms.

18. The method according to claim 14, wherein the running tool driver is a tractor or a jointless pipe coupled to the running tool.

19. The method according to claim 14, wherein at least one sensor is selected from the group consisting of casing collar locators, camera sensors, fiber optic sensors, and acoustic sensors.

20. The method according to claim 14, wherein the expandable member comprises a shape-memory organic polymer which expands when its glass transition temperature is exceeded.

21. The method according to claim 14, wherein the expandable member further comprises one or more attachment devices to further inhibit movement of the perforation blocking sleeve.

22. The method according to claim 14, further comprising a step (k) of solubilizing the expandable member to allow one or more of the perforation blocking members to be removed from the perforated well casing.

23. The method according to claim 14, further comprising a step (1) of solubilizing the perforation blocking sleeve.

24. A downhole assembly for use in well restimulation comprising:

(a) a plurality of perforation blocking sleeves each comprising a first anchoring device;

(b) at least one expandable collar comprising a shape-memory organic polymer which expands when its glass transition temperature is exceeded, the expandable collar being secured to an external surface of each of the perforation blocking sleeves;

(c) a running tool for transporting the plurality of perforation blocking sleeves and expandable collars within a perforated well casing;

(d) a running tool driver for moving the running tool, perforation blocking sleeves and expandable collars within the perforated well casing; and (e) one or more sensors configured to detect perforation clusters within the perforated well casing;

wherein the first anchoring device secures each perforation blocking sleeve over a perforation cluster within a perforated well casing, each perforation blocking sleeve defining a flow channel in fluid communication with a principal flow channel defined by the well casing;

wherein the running tool is remotely and individually uncoupled from each of the perforation blocking sleeves; and wherein the running tool and the running tool driver are retractable through the flow channel of each the perforation blocking sleeves.

* * * * *